US005316486A

United States Patent [19]

Tanaka et al.

[11] Patent Number: 5,316,486

[45] Date of Patent: May 31, 1994

[54] CONNECTOR ASSEMBLY FOR FILM CIRCUITRY

[75] Inventors: Mitsuho Tanaka; Akira Katsumata; Hiroshi Arisaka, all of Tokyo, Japan

[73] Assignee: KEL Corporation, Tokyo, Japan

[21] Appl. No.: 899,688

[22] Filed: Jun. 16, 1992

Related U.S. Application Data

[63] Continuation-in-part of Ser. No. 689,348, Apr. 22, 1991, Pat. No. 5,156,553.

[30] Foreign Application Priority Data

| | | | |
|---|---|---|---|
| Jun. 17, 1991 | [JP] | Japan | 3-171680 |
| Jun. 17, 1991 | [JP] | Japan | 3-171681 |
| Jun. 17, 1991 | [JP] | Japan | 3-171682 |
| Jun. 17, 1991 | [JP] | Japan | 3-171683 |
| Jun. 17, 1991 | [JP] | Japan | 3-171684 |

[51] Int. Cl.[5] ..... H01R 9/09

[52] U.S. Cl. ..... 439/62; 439/67; 439/496

[58] Field of Search ..... 439/62, 67, 74, 77, 439/329, 260, 267, 493, 495, 496, 636, 637

[56] References Cited

U.S. PATENT DOCUMENTS

| | | | |
|---|---|---|---|
| 3,154,365 | 10/1964 | Crimmins | 439/633 |
| 3,922,054 | 11/1975 | Dechelette | 439/329 |
| 4,815,979 | 3/1989 | Porter | 439/62 |
| 4,911,653 | 3/1990 | Walton et al. | 439/493 |

FOREIGN PATENT DOCUMENTS

| | | | |
|---|---|---|---|
| 2513635 | 10/1975 | Fed. Rep. of Germany | 439/496 |
| 40-2588 | 2/1965 | Japan . | |
| 1472688 | 5/1977 | United Kingdom . | |

*Primary Examiner*—Neil Abrams
*Attorney, Agent, or Firm*—Robert W. J. Usher

[57] ABSTRACT

A film circuit connector in which respective conductive tracks in film contact areas on front, mating faces are pressed together into electrical connection between side walls of a metal channel-section receptacle spring and a compressible elastomeric plug spring which engage respective rear faces of the films, the compressible plug spring providing a counter-force to the receptacle spring force, accommodating any variations in receptacle spring force arising longitudinally thereof, ensuring constant contact force between all tracks. Tabs for anchoring and grounding the receptacle spring to the circuit board are struck out and bent down from opposite walls of the receptacle spring, enabling electrical shielding of contact areas. Linking portions of conductive tracks connecting the mating contact portions on the front face of the film to board connecting portions, are formed on the rear face of the film for electrical and mechanical protection and may be insulated on all sides. Film positioning and clamping members in the receptacle locate end film portions inwardly minimizing occupation of board space.

51 Claims, 37 Drawing Sheets

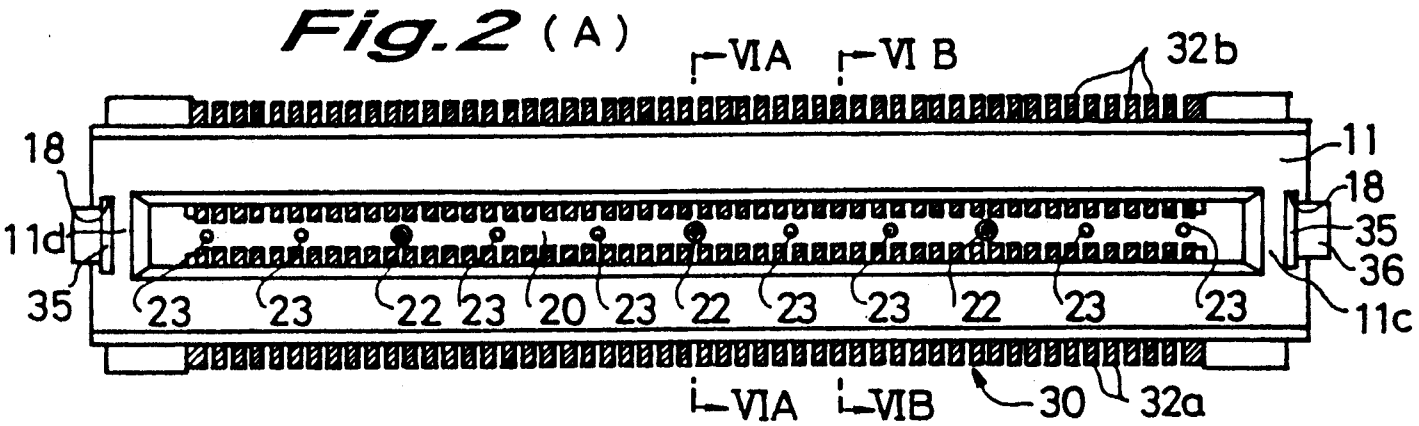
Fig.2 (A)
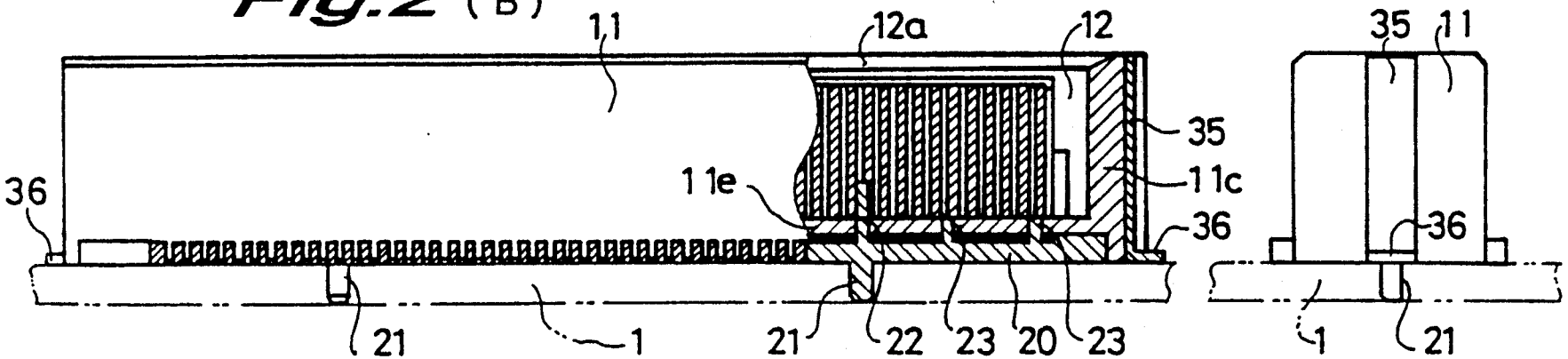
Fig.2 (B)
Fig.2 (C)

Fig. 9 (A)
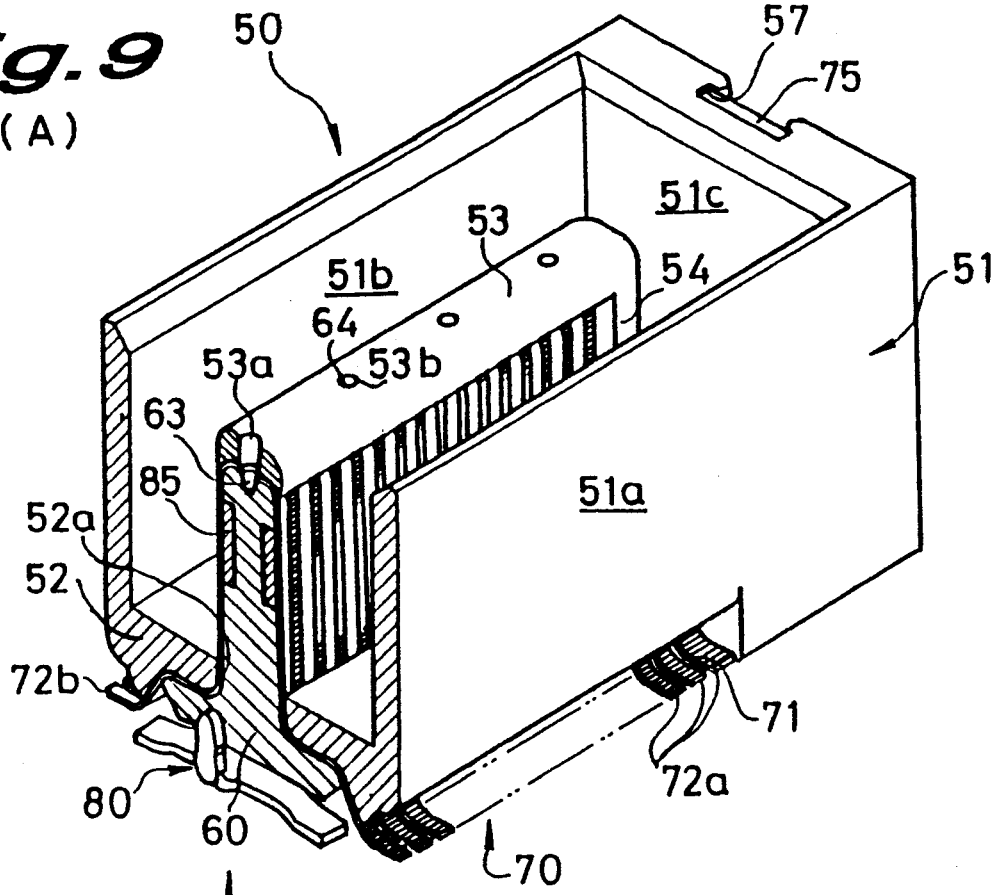
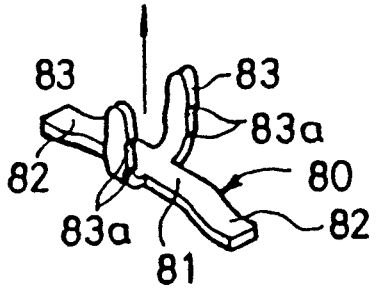
Fig. 9 (B)
Fig. 12
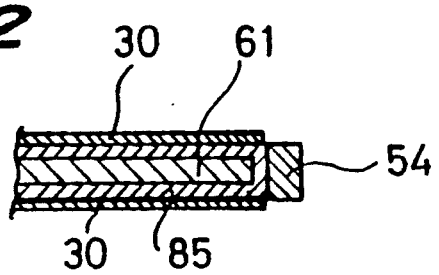

51
51a
51b
51c
51d
52
52a
53
53a
53b
54
55
57
58
60
62
63
64
65
66
67
70
75
76
80
82
83
85
2
XII A
XII B
XII

CONNECTOR ASSEMBLY FOR FILM CIRCUITRY

This is a continuation-in-part application of Ser. No. 07/689348 to Katsumata et al filed Apr. 22, 1991, now U.S. Pat. No. 5,156,553, the disclosure of which is incorporated herein by reference.

FIELD OF THE INVENTION

The invention relates to film circuit connectors and to components thereof, in particular, to film circuitry, for circuit board applications.

BACKGROUND OF THE INVENTION

The increasing miniaturization of electrical devices together with the often conflicting requirements for high volume, mass production at low manufacturing and applied cost but with zero defect, place exacting demands on connectors and associated circuitry.

Attempts to satisfy such requirements are described in the above-mentioned parent application as well as in Japanese patent publication number 3-112082 published May, 1991 in which the receptacle connector 310 of a film connector comprises a housing 311 molded in one piece of insulating plastic material with a plug receiving cavity 311*a* opening to a mating face 311*b*, film circuit supporting members 312 and 313 respectively, in each of which flexible film circuits 314 and 315, respectively, are insert molded to form integral bodies retained inserted in the housing 311 by an elongate T-section base member 317. Prior to insertion, a pair of identical helical coil springs 316 are mounted in longitudinally extending through-slots or grooves in the film circuit supporting members 312, 313 behind film circuit contact areas 314*a* and 315*a* biassing then to protrude into the cavity 311*a*.

The plug connector 320 comprises a housing 321 having a receptacle connector receiving cavity 312*a*, first and second film circuit supporting and locating members 322 and 323, respectively, first and second film or sheet-form flexible circuits or boards 324 and 325, respectively, in-molded in respective film circuit supporting members to form integral bodies which are inserted in the housing and retained by a base member 327 of generally T-shaped cross-section. Film circuit contact areas 324*a* and 325*a* remain exposed during the in-molding process and are pressed into engagement with contact areas 314*a* and 314*b*, respectively, on mating the plug and receptacle connectors with resilient depression of the springs 316. Connection to respective circuit boards 301 ad 302 is effected with training portions of the film circuit which extend out of the respective housings adjacent the circuit boards by a reflow soldering technique.

A disadvantage of such approach is that the counterforce to the spring contact force acts directly on the plastic walls 311 of the receptacle housing tending to distort or distend the walls by bending with a risk of breakage and decrease or loss of contact force. Clearly, increasing the contact force to assure more reliable electrical connection increases the stress on the housing while any distortion of the housing walls, which may be progressive over time, e.g. creep, will reduce the contact force and reduce reliability.

Similar problems may arise with another prior receptacle connector described in Japanese patent publication number UM 56-59774 and acknowledged as prior art in the parent application with reference to FIGS. 21 and 22 thereof, in which film circuits have leading ends secured around a cylindrical body of metal loaded elastomer located in a housing compartment adjacent the mating face and providing the contact force.

In a different approach, disclosed in Japanese Patent Publication 40-2588 and U.S. Pat. No. 3,154,356 to Crimmins, issued Oct. 27, 1964, reliance for contact pressure between engaging film circuits of matable parts and receptacle connectors is placed on inwardly projecting, curved, protuberances on end portions of walls of a spring which has been bent into channel or U-section within which the film circuit extends in slack condition. The spring is formed by bending a metal plate resulting in risk of an unevenness of the curvature of the protuberance along the length of the spring which may also be subject to relaxation while, the slack condition of the film circuit increases risk of shift and contact misalignment, particularly with conductive tracks at desirably small pitches. In addition, in that construction, the channel walls should be relatively long (high, increasing the size of the connector structure undesirably).

There is clearly a risk that an uneven spring contact force will result in faulty connection to some circuit paths.

Further problems may arise in using conventional film circuitry both on mating, when frictional engagement or butting together of the conductive tracks of the film circuit possibly causes peeling or abrasion thereof, or inadvertent cross connection at the surface of the circuit board arising from using the reflow solder process with conductors at very close pitch.

Other problems arise in securely anchoring the connectors to the circuit board with increased risk of accidental abutment or strain as a result of the high density of components on the circuit board and the consequently increased desirability of at least some degree of effective electrical shielding while occupying a minimum of circuit board area.

SUMMARY OF THE INVENTION

It is one object of the invention to obviate or ameliorate the above-mentioned disadvantages in eliminating both the reactive contact spring force acting on the housing wall and ensuring substantially uniform contact force along the length of the spring to respective conductive tracks of the film circuit.

It is a further object of the invention to obviate the problem of cross-connection or short circuiting between the individual conductive tracks by retaining the film circuit in the channel section spring precisely located and in taut condition both after assembly and at an early stage during assembly and maintaining the precise positions throughout the assembly process obviating any requirement for adjustment of the film circuit position at a later stage which would involve difficult and time consuming manipulation.

A further object of the invention is to utilize a channel spring construction to establish contact force while enabling the connector to be of acceptably low height and size while avoiding irregularity in contact force.

It is also desirable to provide a film circuit adapted to minimize problems of cross connection both with the connector and to the circuit board.

Further objects of the invention are to provide conectors which are economic to manufacture and mount on the circuit board using mass production techniques.

According to one aspect of the invention there is provided a connector assembly for film circuitry comprising matable plug and receptacle connector members, the receptacle member including an insulating housing having a mating face and providing a plug receiving cavity opening to the mating face; a channel section spring member having a base and side walls upstanding from opposite sides of the base, film circuit pressing protuberances on opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls; the plug connector comprising a plug housing having a mating face and a plug-like film circuit supporting member; and, a film circuit supported on the film circuit supporting member and having mating contact areas extending away from the mating face in taut condition, at least one resiliently compressible spring means extending longitudinally of the film circuit supporting member behind the mating contact areas of the film circuit at locations aligned with the protruberances, in a fully mated condition of the connector whereby, on mating the plug and receptacle members, the film circuit supporting member carrying the film circuit is received in the channel mouth between the protuberances flexing resiliently the side walls apart so that the protuberances and the compressible spring press between them corresponding contact areas of the two film circuits together into engagement to effect permanent electrical connection between respective conductive tracks thereof.

Contact force variations arising from imperfections in forming or subsequent relaxation of the receptacle spring will be accommodated by the resilient compression of the opposed plug spring located behind the film circuit contact area ensuring a substantially predetermined and constant contact force between all circuits.

The compressible plug spring may be formed by an endless, possibly elastomeric band, encircling the film circuit supporting member and may suitably be retained in a groove formed therein or may be constituted by separate strips located on respective opposite sides of the film supporting member.

The receptacle spring may suitably be stamped and formed from sheet metal stock and anchoring tab portions may be struck from respective opposite sides thereof at locations adjacent the base to extend downwardly therefrom and have laterally extending circuit board connecting and anchoring portions to effect both mechanical anchoring to the circuit board and electrical connection thereto so that the receptacle spring member may act as a shield.

Means may be provided on the receptacle housing to maintain the side walls of the receptacle spring resiliently flexed apart in prestressed condition.

Such arrangement may both advantageously reduce the amount of flexure required of the receptacle spring to produce a satisfactory contact force on insertion of the plug member therein thereby in practice reducing the insertion force and frictional effects caused by mating, further reducing the insertion force and abrasive wear of the contact areas.

The prestressing means may conveniently progressively urge the receptacle spring side walls apart during assembly thereof into the housing.

According to another aspect of the invention there is provided a connector assembly as described above in which the receptacle housing cavity has opposite, elongate side walls and opposite end walls extending away from the mating face and defining an aperture remote from the mating face, an elongate film circuit locating rib of greater lateral width than the mouth of the receptacle spring extending along the housing, medially of the aperture, an elongate spring mounting member of rigid insulating material having receptacle spring locating means and film circuit locating portions at opposite sides thereof, the film circuit being receivable in the housing with the medial portion thereof located under the film circuit locating rib and the contact areas extending through the aperture on respective opposite lateral sides of the film circuit locating rib into the cavity towards the mating face and end portions folded back away from the mating face and returned through the aperture on respective opposite lateral sides of the rib, the spring mounting member being insertible into the aperture with the spring base located on the spring locating means by flexure apart of the channel walls riding over the film circuit locating rib with the channel side wall portions an protruberences received in respective folds formed in the film circuit on opposite sides of the medial portion and with the medial portions of the film trapped between the rib and the base of the receptacle spring, the film circuit locating portions engaging trailing end portions of the film circuit trapping them against the respective opposite side walls of the housing and extending out of the housing exposed for connection to a circuit board and with contact areas of the film circuit located by the respective spring protruberences extending inwardly on respective opposite sides of the channel adjacent the mating face, cooperable means being provided for securing the channel spring mounting member to the housing.

This may ensure accurate location of the film circuit is maintained at all stages of assembly with the housing and subsequently during and after mating with the plug connector. Upward and lateral movement of the film circuit is limited so that accurate connection of corresponding tracks of the mating film circuits can be established, in other words.

In one embodiment, the receptacle housing has means engagable with the spring for urging the side walls apart into prestressed condition, preferably, progressively, by insertion of the spring into the housing.

This reduces spring movement and insertion forces, particularly frictional, during mating and decreases risks of misalignment and consequential damage in view of the wider spring mouth in the preloaded condition.

According to another aspect of the invention, the film circuit comprises a series of conductive tracks extending across a web of insulating material away from the medial portion and having a row of mating contact portions in the contact areas exposed to the front mating contact face joined by respective linking portions insulated from the contact face, preferably by location on the rear face of the web, to respective board connecting portions exposed to a rear face for connection to a circuit board.

The isolation of the linking portions of the conductive tracks from the front, mating contact face obviates risk of wear or peeling of the conductors otherwise possibly arising as a result of the high frictional force produced on mating. In addition, since the linking conductors are concealed on the rear surface of the film, there is no risk of shorting between the individual linking conductors otherwise possibly arising if metal granules or metal powder is accidentally accumulated on the front surface of the film member trapped in the receptacle spring.

An insulating coating may advantageously also be place on the linking portions to cover the exposed rear surfaces thereof where the receptacle spring member is of metal.

BRIEF DESCRIPTION OF THE DRAWINGS

Specific embodiments of the invention will now be described by way of example only with reference to the accompanying drawings in which:

FIGS. 2(*a*), 2(*b*) and 2(*c*) are top plan, side elevation, partly in cross section, and end elevational views of the receptacle connector of claim 1;

FIG. 6(*c*) is a fragmentary cross-sectional view taken along line 6*c*—6*c* of FIG. 6(*b*);

FIG. 9(*a*) is a perspective view, partly in cross-section, of a first embodiment of plug connector according to the invention;

FIG. 9(*b*) is a perspective view of an anchoring element for the plug connector of FIG. 9(*a*);

FIG. 12 is a fragmentary, cross-sectional view taken in a horizontal plane extending through the film circuit supporting member of the connector of FIG. 9(*a*);

FIGS. 38(*c*)–38(*g*) are cross-sectional views taken, respectively, along lines 38(*c*)–38(*g*) of FIG. 38(*a*);

DESCRIPTION OF PREFERRED EMBODIMENTS

Figure 1:
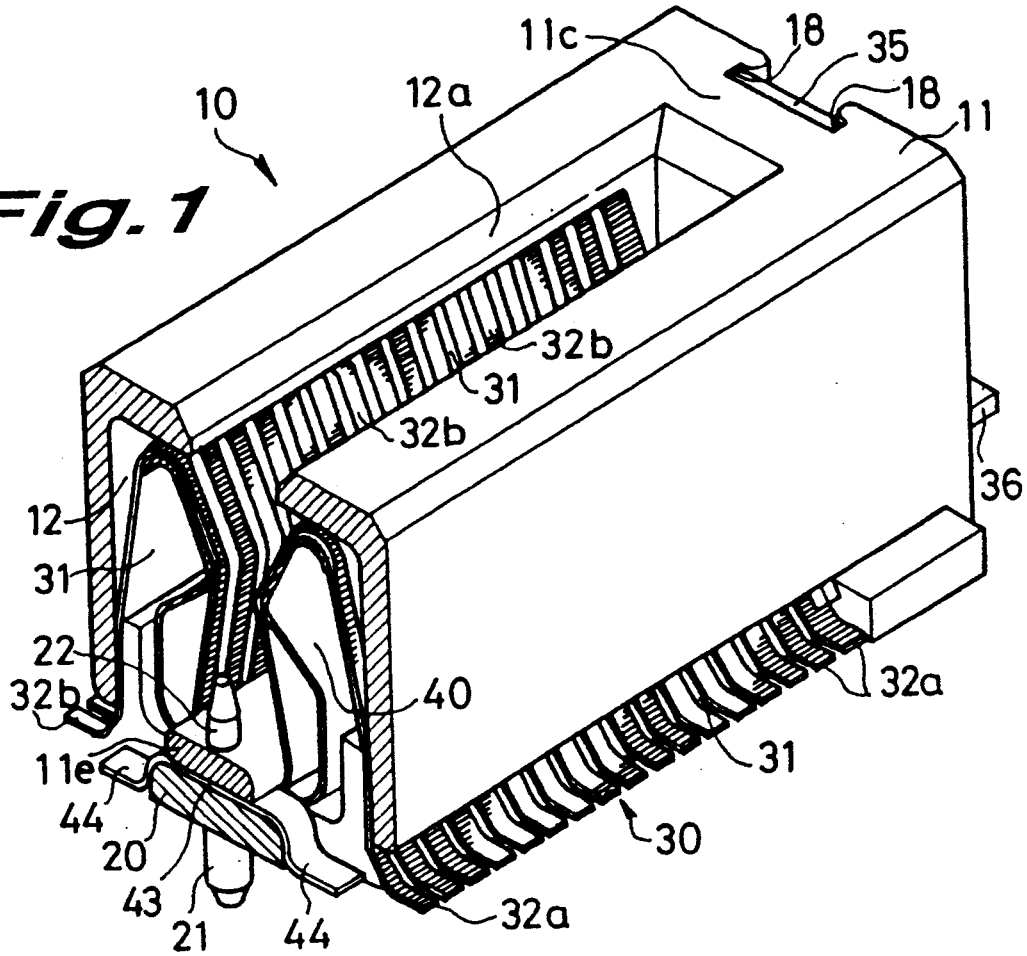
FIG. 1 is a perspective view, partly in cross section of a first example of receptacle connector according to the invention.

As shown in FIGS. 1–8, the receptacle connector comprises a housing 10, a receptacle spring mounting member 20, a film circuit 30 and a channel-section receptacle spring 40.

The receptacle connector 10 comprises a rectanguloid housing 11 molded in one piece of insulating plastic material and having opposite elongate side walls 11*a* and 11*b* and end walls 11*c* and 11*d*, respectively, which extend away from a slotted plug connector receiving mating face 12*a* and define a plug receiving cavity 12 open to a board engaging face, remote from the mating face. An elongate film circuit supporting rib 11*e* extends medially of the board engaging face between opposite end walls. A series of locating and retention pin receiving apertures are formed at intervals along the length of the rib.

A pair of receptacle spring prestressing or preloading guide projections 16 are formed on each end wall 11 extending away from the mating face towards the board engaging face at locations on each side of the slot and have lowermost entry ends formed with ramp or cam surfaces 16*a*. Outer surfaces of respective end walls are formed with grooves 18 extending between the mating and board engaging faces for the receipt of known metal mounting elements 35 of L-shape, as force fits, such mounting elements having transverse leg portions 36 at the mating face for connection to the circuit board by reflow soldering, securely to attach the receptacle connector 10 to the circuit board.

As best seen in FIGS. 1 and 2(*b*), the film circuit locating rib 11*e* and lower longitudinal edges of the side walls 11*a* and 11*b* are spaced from the circuit board by feet formed at opposite ends of the connector, defining a spring mounting member receiving recess above the circuit board.

The receptacle spring mounting member 20 is of generally channel-section having a central receptacle spring base mounting portion and mutually opposite, longitudinally extending film circuit locating side walls 25. A series of insertion guide pins 22 upstand at spaced apart locations from the upper surface of the receptacle spring base supporting portion together with a series of spaced apart retaining pins 23, shorter than the insertion guide pins. A pair of anchoring pins 21 depend from the lower surface of the receptacle spring supporting member for anchoring receipt in respective apertures in a circuit board. Pairs of cut-outs are formed in the receptacle spring base supporting member on respected opposite sides thereof at locations aligned with respective anchoring pins 21, as most clearly seen in FIGS. 3 and 6(*a*).

Figure 6:
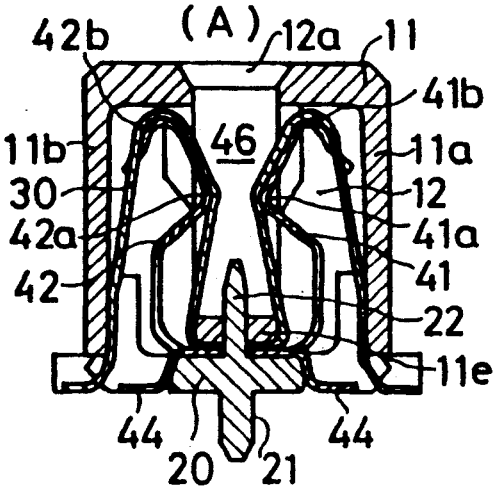
FIGS. 6(*a*) and 6(*b*) are, respectively, cross-sectional views taken along lines 6(*a*) and 6(*b*) of FIG. 2(*a*)
Figure 6:
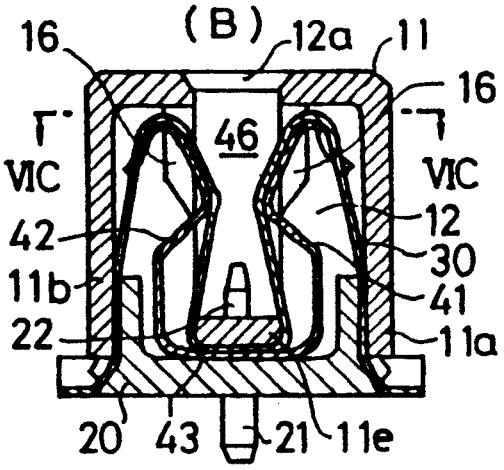
Figure 6:
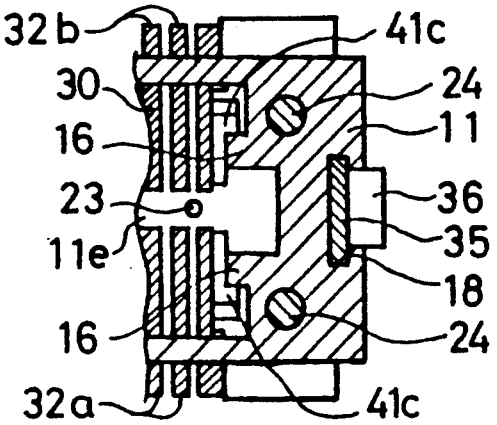
Figure 7:
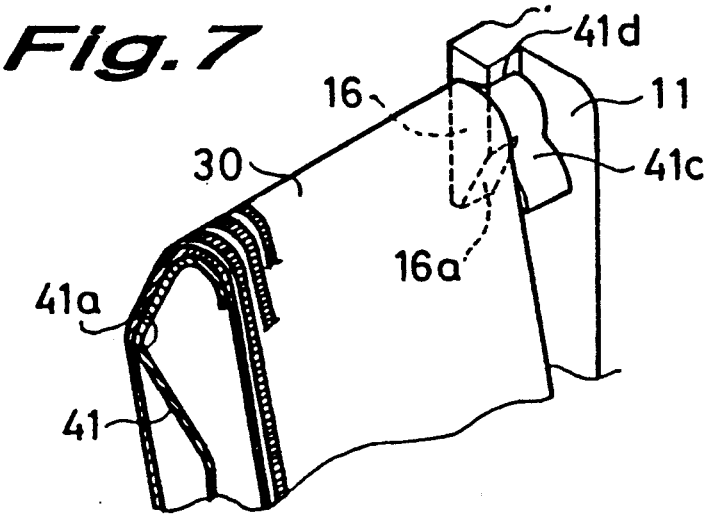
FIG. 7 is a fragmentary perspective view of the first example of receptacle connector.

As shown in FIG. 6(*c*) a pair of retention pins 24 upstand from respective opposite ends of the receptacle of the spring mounting member and are receivable as a force fit in complementary sockets (no shown) in the end walls of the receptacle housing to securely assemble the receptacle spring mounting member therein.

The receptacle spring 40 is stamped and formed from a metal plate into a channel-section with a base wall 43 from opposite longitudinal sides of which upstand side walls 41 and 42, respectively, which walls are further bent to form convex, inwardly extending, film circuit pressing protuberances 41*a* and 42*a* having longitudinally extending axes of generation and defining between them a channel mouth of restricted size and which are reversely bent to extend outwardly at uppermost free ends forming part tubular, longitudinally extending stiffening portions 41*b* and 42*b*. Tab-like, cam following extensions 41*c* and 42*c* having inner edges 41*d* and 42*d*, respectively, extend longitudinally and laterally outwardly from opposite ends of the respective part tubular portions 41*b* and 42*b* for spring prestressing purposes Tabs 44, 44*a* are struck out from respective opposite side walls 41 and 42 at locations adjacent the base 43, bent to extend downwardly below the base and formed at free ends with laterally outwardly extending board anchoring and, preferably, electrically connecting, portions for surface mount connection to a circuit board. A row of retention and guide pin receiving apertures 45 are drilled or punched in the base 43 at locations corresponding to the locations of the guide and retention pins 22 and 23.

Figure 5:
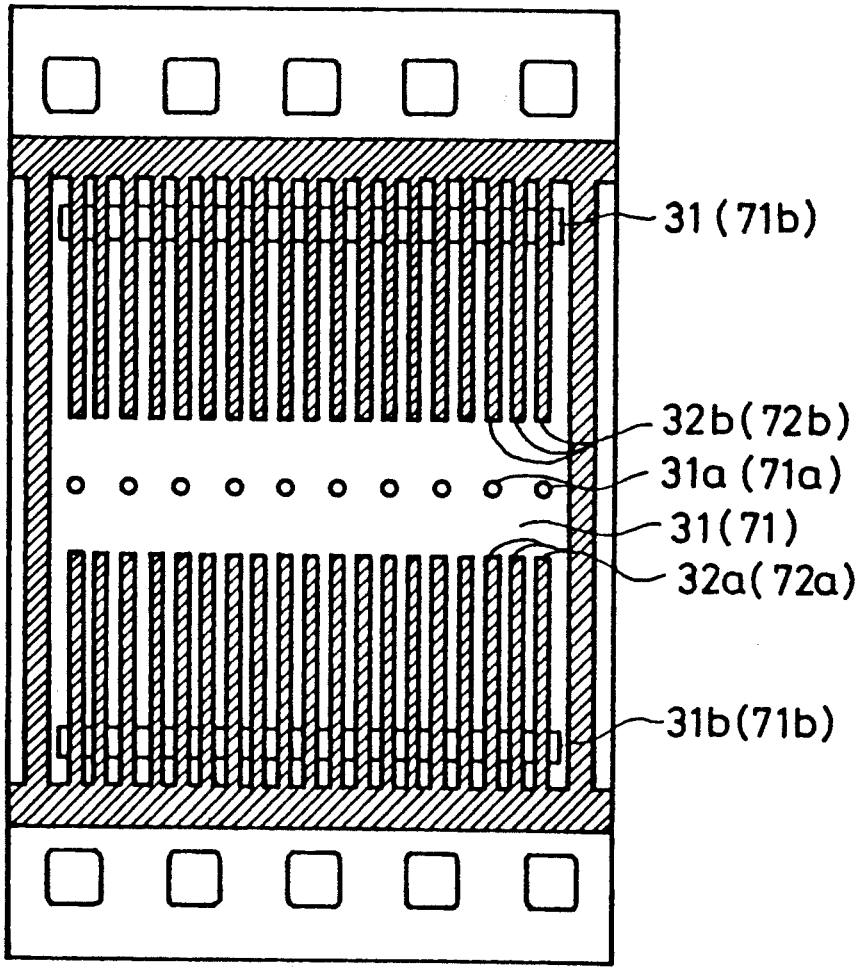
FIG. 5 is a plan view of a precursor of a film circuit of the first example of receptacle connector.

As seen most clearly in FIG. 5, the precursor of the film circuit 31 is PTC and comprises a series of conductive layers or tracks 32*a* and 32*b* formed on a common surface of an insulating web 31 to extend in parallel relation away from a medial portion formed with a row of guide and retention pin receiving apertures 31*a*. It will be understood that the term flexible circuit includes any suitable form of flexible circuitry or flexible circuit board, as described in the parent application.

A longitudinally extending, strip-like, portion of the web, at a location remote from the medial portion, is cut away from each side of the medial portion to provide apertures or windows 31*b* through which individual conductors of trailing ends 32*a*, 32*b* of the film circuit are exposed for electrical connector to a circuit board when installed in the connector.

Prior to assembly of the receptacle connector, the peripheral portions of the film circuit, including the outermost rectangular conductive portions are also removed, for example, by severing with one line of severance extending along the outermost edge of respective windows 31*b*, as necessary for mounting in the receptacle connector.

Figure 8:
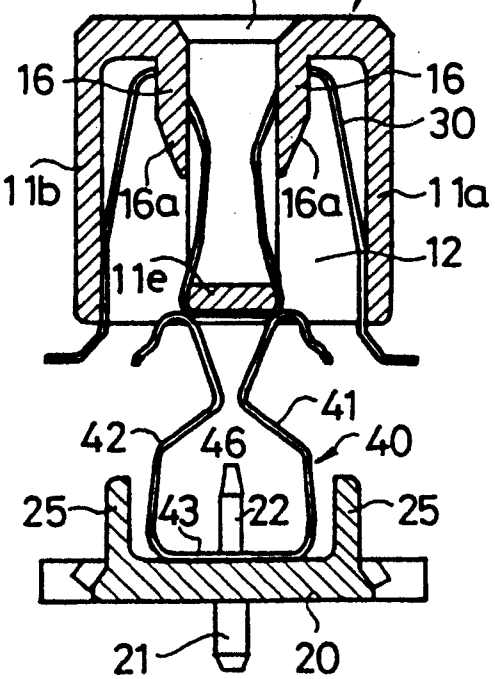
FIGS. 8(*a*), 8(*b*) and 8(*c*) are cross-sectional views taken, respectively, along lines corresponding to 6*b*—6*b* of FIG. 2(*a*) showing the components of the first example of receptacle connector at progressive stages of assembly.
Figure 8:
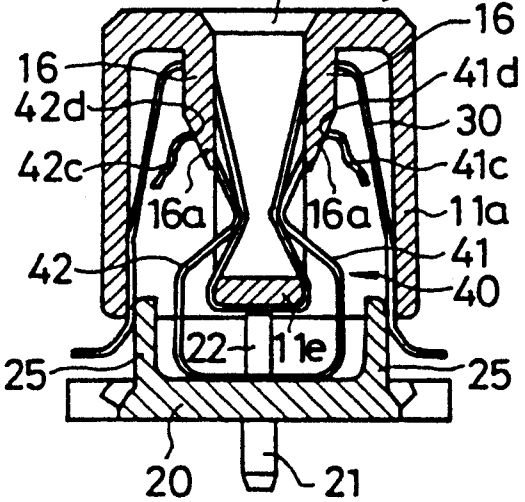
Figure 8:
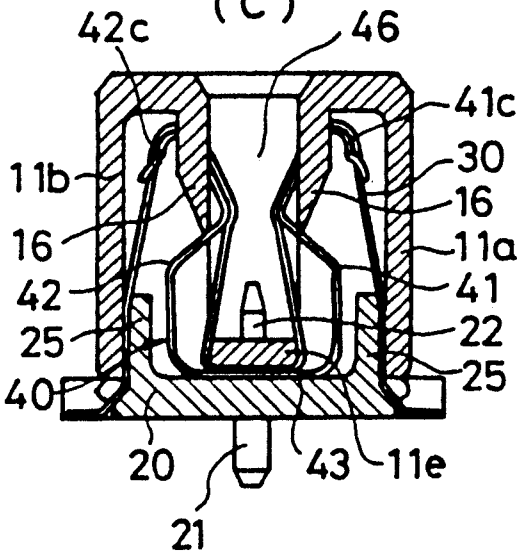
Figure 10:
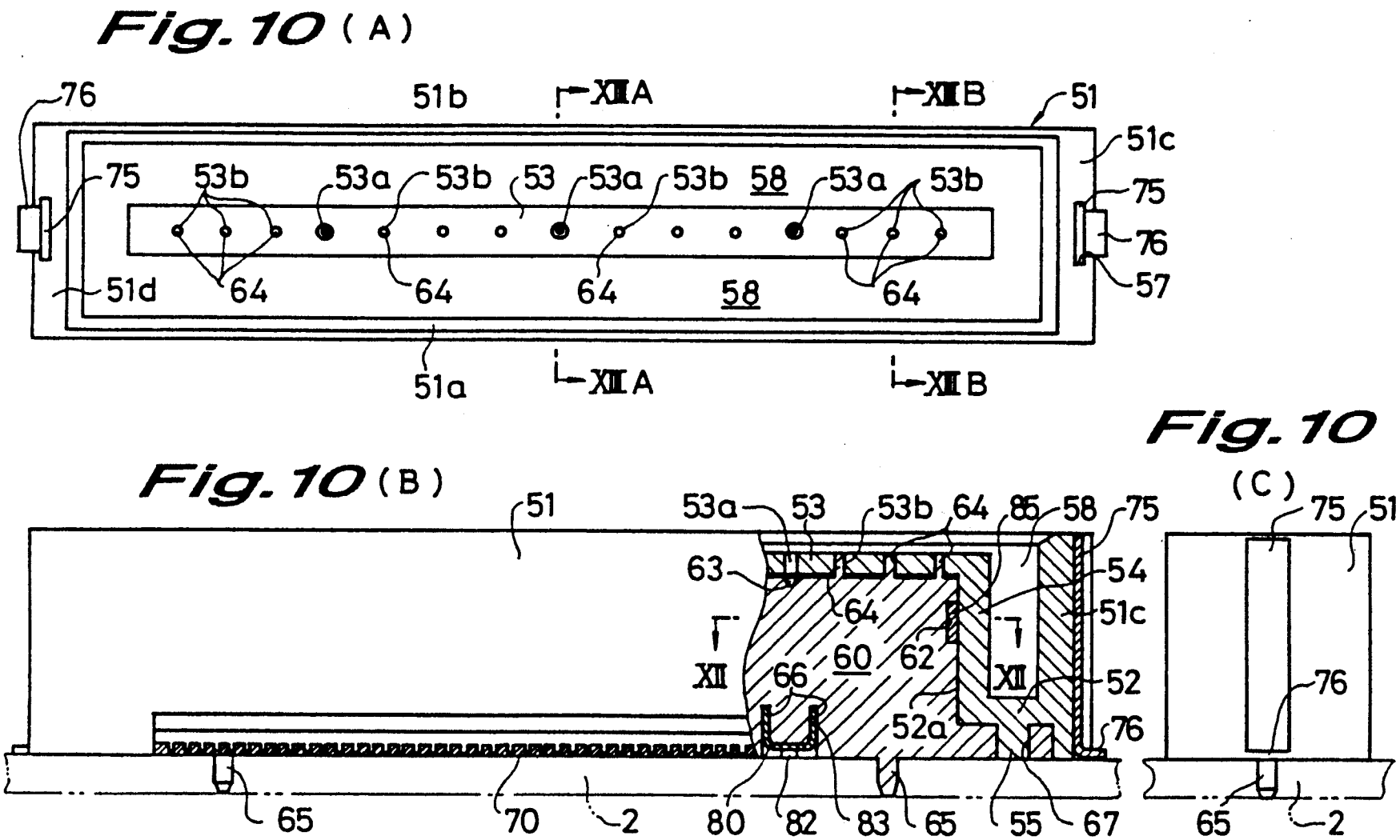
FIGS. 10(*a*), 10(*b*) and 10(*c*) are, respectively, plan, side elevational partly in cross-section, and end elevational views of the plug connector of FIG. 9(*a*)
Figure 11:
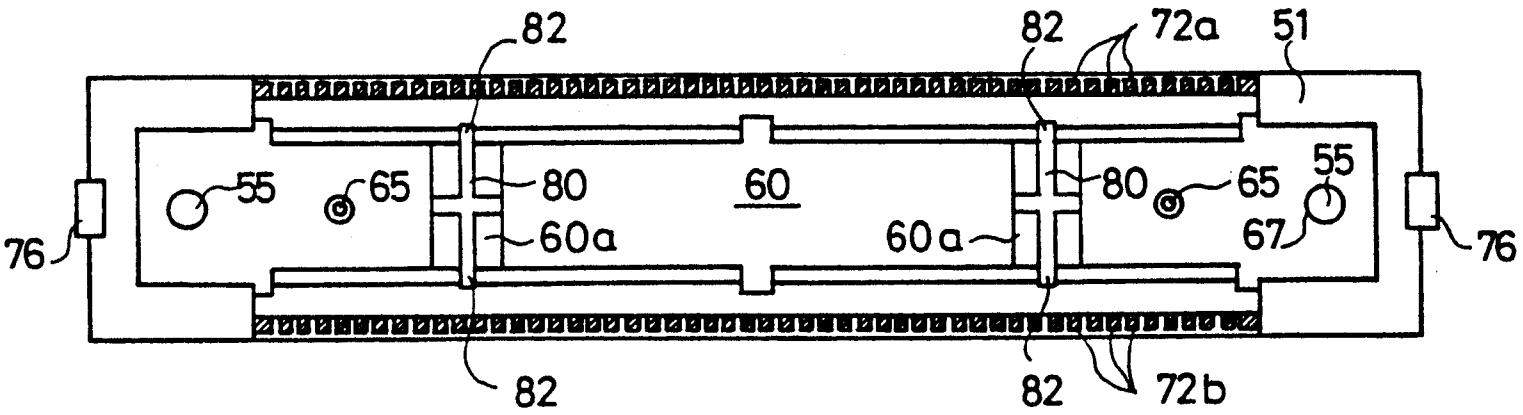
FIG. 11 is an underplan view of the plug connector of FIG. 9(*a*)
Figure 13:
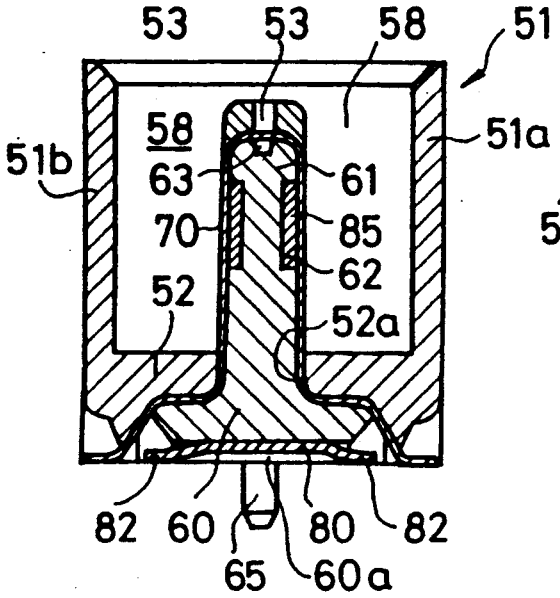
FIGS. 13(*a*) and 13(*b*) are, respectively, cross-sectional views taken along lines 13*a* and 13*b* of FIG. 10(*a*)
Figure 13:
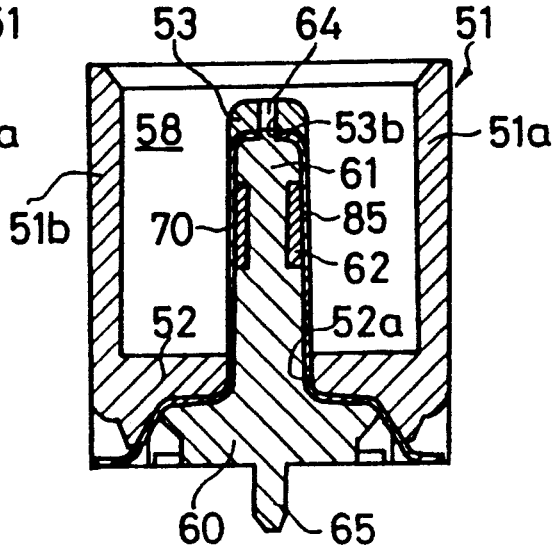

As best seen in FIGS. 8(*a*), 8(*b*) and 8(*c*), the receptacle connector is assembled by firstly positioning the film circuit (with unrequired portions removed) in the receptacle housing with the medial part covering the lower surface of the rib 11*e* and opposite ends extending upwardly towards the mating face on respective opposite sides of the rib 11*e* into the cavity and folded back to form an M-shape so that trailing ends extend downwardly adjacent the side walls, out of the apertures at the mating face and contact areas are located in the cavity facing each other of opposite sides of the slot.

Alternatively, the film circuit 30 may be pushed directly into the cavity, possibly carried by the receptacle spring mounted spring premounted on the receptacle spring mounting member.

The receptacle spring 40 is then mounted on the receptacle spring mounting member by locating the base 43 on the locating portion with the guide and retention pins 22 and 23 projecting through the respective apertures 45 accurately positioning the receptacle spring on the receptacle mounting member. The subassembly so formed is then inserted through the aperture into the receptacle cavity with the receptacle spring protuberances on the side walls being flexed apart by the rib and riding thereover and the inner edges 41*d* and 42*d* of cam following extensions 41*c* and 42*c*, respectively, riding up the ramp surfaces 16*a*, flexing the protruberance apart adjacent the mouth until the camming extensions rest on uppermost straight portions with the receptacle spring in prestressed or preloaded condition.

During insertion, the insertion guide and retention pins 22 and 23 are received in the apertures 23 in the film circuit and in the apertures formed in the rib 11*e* with the guide pins projecting upwardly therefrom so that the film circuit is secured reliably and positioned accurately in the housing gripped between the base 43 of the receptacle spring and the lower surface of the rib with the film circuit end portions riding over respective protuberances.

At the same time, the film circuit locating walls 25 of the receptacle spring mounting member are pressed against portions of respective receptacle housing side walls defining the aperture by the walls 25 of the receptacle spring mounting member.

During final stages of assembly, the securing pins 24 of the receptacle spring mounting member are received as force fits in sockets in the receptacle housing which, together with the engagement of the guide and retention pins 22 and 23 in the apertures reliably, secures the film circuit and the receptacle spring mounting member in the housing.

The assembled receptacle connector is secured to the circuit board 1 by surface mount techniques, the anchoring pins 21 being received in apertures in the circuit board and connection of separated and exposed conductors of trailing end portions 32*a* to respective tracks of the circuit board by a reflow soldering technique. In addition, the tabs of legs 44 are also soldered to the circuit board and the feet 36 of the L-shaped anchoring members 35 which have been force fitted into respective grooves 18 at opposite ends of the receptacle housing are soldered to the board for additional anchoring.

As shown in FIGS. 9–13, the plug connector 50 comprises an outer housing 51 which receives a film circuit supporting member 60 carrying a film circuit 70.

The outer housing 51 is molded in one piece of plastic material into rectanguloid shape having opposite side walls 51*a* and 51*b* and opposite end walls 51*c* and 51*d*, respectively, extending between front, mating and rear board engaging faces. A base wall 52 extends transversely across the housing adjacent the board engaging face defining, with the side and end walls, a receptacle housing receiving cavity open to the mating face. An elongate film circuit supporting member receiving aperture 52*a* extends centrally through the base wall 52. Columnar portions 58 upstand from the base wall at locations adjacent in space from the respective end walls at opposite ends of the aperture 52*a* and are joined at upper ends by a bridging portion 53 aligned over the aperture 50*a* and forming a leading end of the plug connector.

A row of apertures 53*a* and 53*b* are formed extending through the bridging portion 53. Attachment pins 55 depend from the base wall at locations between the columnar portions 54 and the end walls and grooves 57 are force fitted with L-shaped mounting members 75 having transverse feet 76, are provided in outside surfaces of the end walls in similar fashion to the receptacle connector.

The outside portions of the side walls are rebated adjacent the circuit board engaging face and a film supporting member receiving recess is formed under the base wall 53, outer wall parts of which diverge, providing film circuit locating shoulders adjacent the circuit board.

The film circuit 70 is similar in structure to the film circuit 30 shown in FIG. 5 and described above but the dimensions are different and corresponding parts are therefore indicated by respective, seventy series numerals, 71, 71*a*, 71*b*, 72*a* and 72*b*.

As shown in FIGS. 9 and 12, the film circuit supporting member 60 has a plate like film circuit supporting wall 61 upstanding from a transverse foot. The wall 61 is of slightly smaller cross section than the aperture 52*a*. A series of guide pin receiving apertures 63 and upstanding retaining pins 64 are formed in the upper leading end of the film supporting wall at intervals corresponding to the guide pin receiving apertures 53*a* and apertures 53*b* for alignment therewith and insertion therein on assembly of the film circuit supporting member with the outer housing 51.

As shown in FIG. 12, a compression spring retaining groove 62 extends completely around the film circuit supporting wall at a central location and a ring or band of elastomer 85 or similar, resilient material is seated therein.

In a modification, such spring retaining groove may be formed only on opposite faces of the film circuit supporting wall and the elastomeric material formed as two strips seated in respective grooves.

Two circuit board anchoring pins 65 depend from the underside of the foot and securing sockets 67 are formed in opposite ends thereof.

Two transverse grooves 60*a* are also formed in the undersurface of the foot or base, communicating with upwardly directed anchoring socket 66. An elongate metal mounting part 80, shown in FIG. 9, has longitudinally extending mounting arms 82 and pressure retention arms upstanding from opposite lateral sides are received as a force fit in the socket 66 to secure the mounting part of the film circuit supporting member with the mounting arms 82 extending horizontally.

The film circuit is installed on the film circuit supporting member with the aperture 71*a* receiving guide pin 64 and the ends dressed down opposite sides of the film circuit supporting walls with contact areas of the film circuit overlying the band spring 85. The self-assembly so formed is then inserted through the aperture through the cavity until the leading end of the film circuit supporting wall seats against the bridging portion 53 gripping the film circuit therebetween and the retention pins 64 are fitted into respective apertures 53*b*.

When so assembled, the insertion pin receiving apertures 63 are aligned with the apertures 71*a* of the film circuit 70 and the apertures 53*a* of the bridging portion 53.

The securing pins 55 of the housing are then received as force fits in the socket 67 of the film circuit supporting member completing securement of the assembly.

The film mating contact areas with tracks 72*a* and 72*b* are then exposed extending down opposite faces of the film circuit supporting wall in taut condition away from the mating face overlying the compressible springs 85 while end portions 70 are clamped between the base wall and the film circuit supporting member 60.

The retention arms 83 of the fastener 80 are force-fitted into respective sockets 66 in the base with tangs or protuberances 83*a* thereof biting into the plastics body for connection of the portions 82 by reflow soldering together with the exposed end portions of film circuits 72*a* and 72*b* to respective conductive tracks of the circuit board 2. When the anchoring pin 65 is inserted into an anchoring aperture in the circuit board and the feet 76 of mounting arms 75 are soldered to the circuit board.

Figure 14:
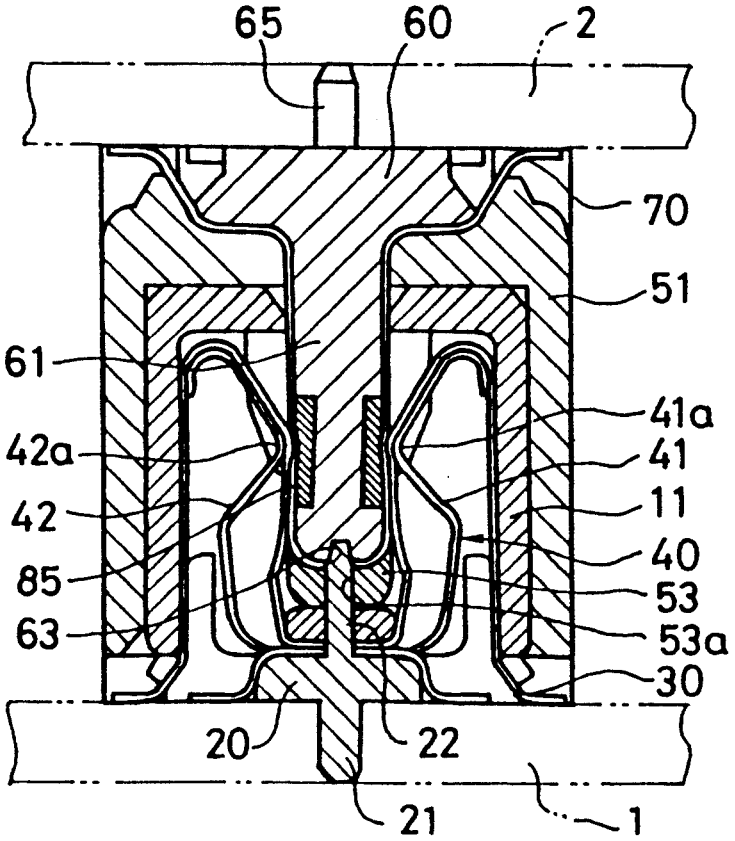
FIG. 14 is a cross-sectional view of the connector assembly with the plug and receptacle connectors in fully mated condition.

On mating the plug and socket connectors, accuracy of alignment is assured by registration and receipt of the guide pins 22 in respective apertures 53*a* of the bridging portion and apertures 63 of the film surface supporting wall 61. During the mating movement, as shown in FIG. 14, the film circuit supporting member urges the receptacle spring protuberances 41*a* and 42*a* apart with resilient deflection thereof and enters the receptacle spring mouth so that conductive tracks 32*a*, 32*b*, 72*a*, 72*b* in respective contact areas of the film circuits 30 and 70 of the plug and receptacle are pressed into engagement by the receptacle spring 40 and the counter force of the resilient compression of the compression spring 85 thereby effecting electrical connection between corresponding conductive tracks on the circuit boards 1 and 2.

Thus, the cooperation of the receptacle and plug springs assures that a predetermined, constant contact pressure is obtained for all tracks in the respective contact areas even if the protruberances 41*a* and 42*a* are unevenly formed or inclined, the compressive force of the spring 85 providing the compensating or accommodating force.

The preloaded condition of the receptacle spring also, in practice, reduces the insertion force and effort (energy) of insertion with less spring movement necessary to obtain a given contact force and further, in view of the widened mouth, reduces frictional effects tending to abrade the film and resist insertion.

The precise dimensioning and positioning of the receptacle spring mouth obtained by such prestress also obviates or ameliorates undesirable deflections of the plug connector to one side on insertion into the receptacle spring.

Figure 15:
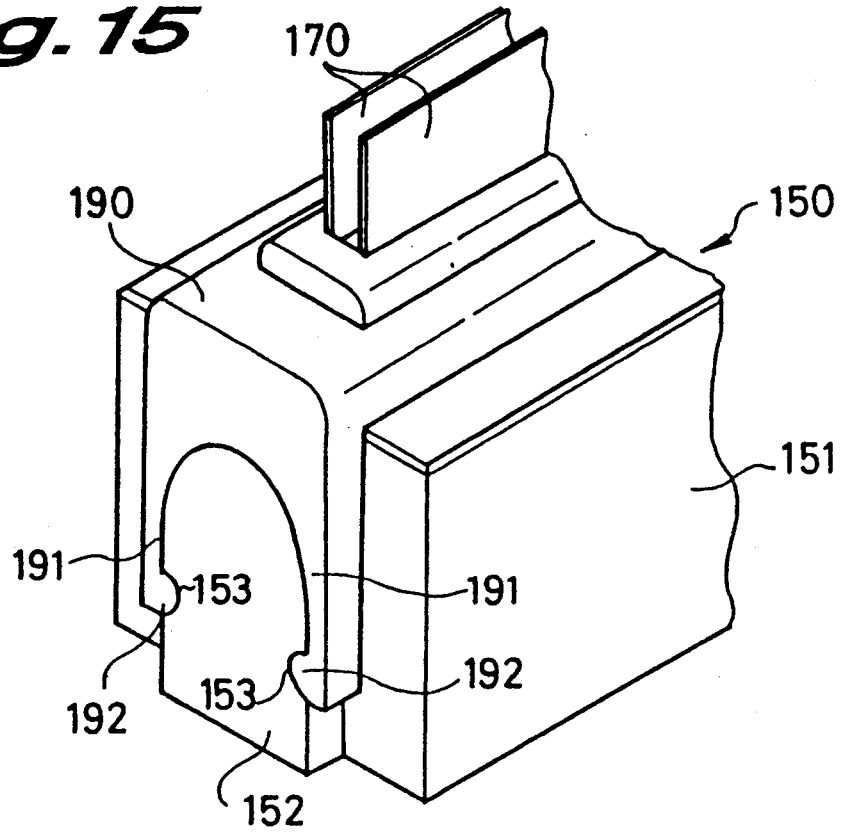
FIG. 15 is a fragmentory perspective view of a second embodiment of plug connector according to the invention.
Figure 17:
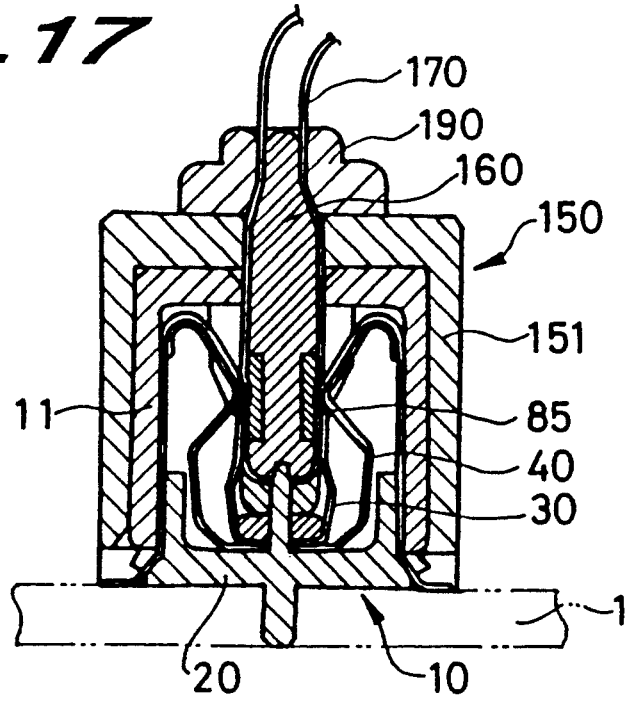
FIG. 17 is a cross-sectional view of the second embodiment of plug connector in fully mated condition with the first embodiment of receptacle connector.
Figure 16:
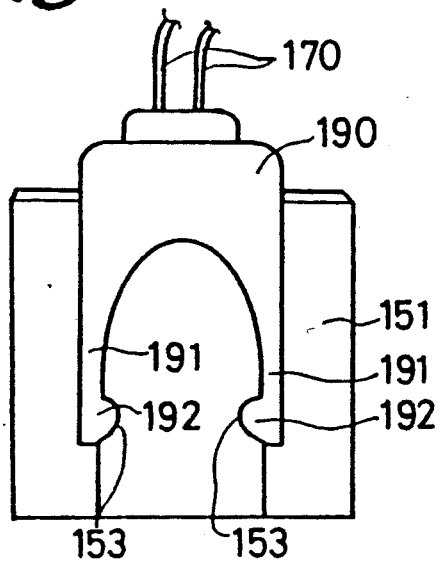
FIGS. 16(*a*) and 16(*b*) are end elevational and fragmentary side elevational views of the second embodiment of plug connector shown in FIG. 15.
Figure 16:
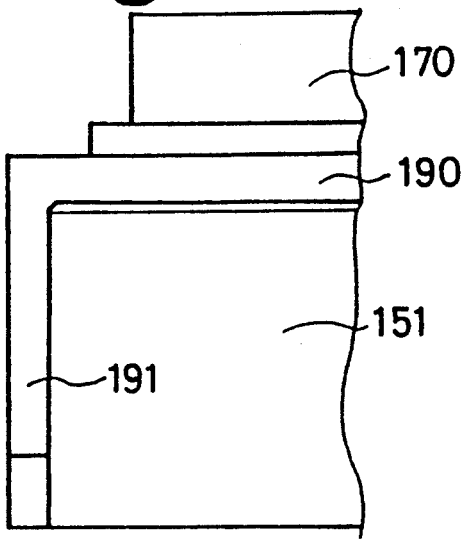

In another example, shown in FIGS. 15–17, the receptacle connector 11' is similar to that described above and is mounted on a circuit board 1, but the plug connector 150 is not board mounted. In this example, the plug connector 150 comprises an outer housing 151, a film circuit supporting member 160, a film circuit 170 and a film circuit clamping means 190. The film circuit clamping means 190 has a central, elongate slot receiving a modified rear end of the film circuit supporting member trapping rearwardly extending trailing end portions of the film circuit therebetween and resilient locking arms 191 having hook-form ends and extending from respective opposite ends of the member and which engage in a snap action over locking grooves 153 of locking shoulders or projections 152 on end walls of the housing 151. The profiles of the opposed surfaces of the slot and film circuit supporting member ensure that good strain relief is provided for the film circuit even if pulled or snagged.

Figure 25:
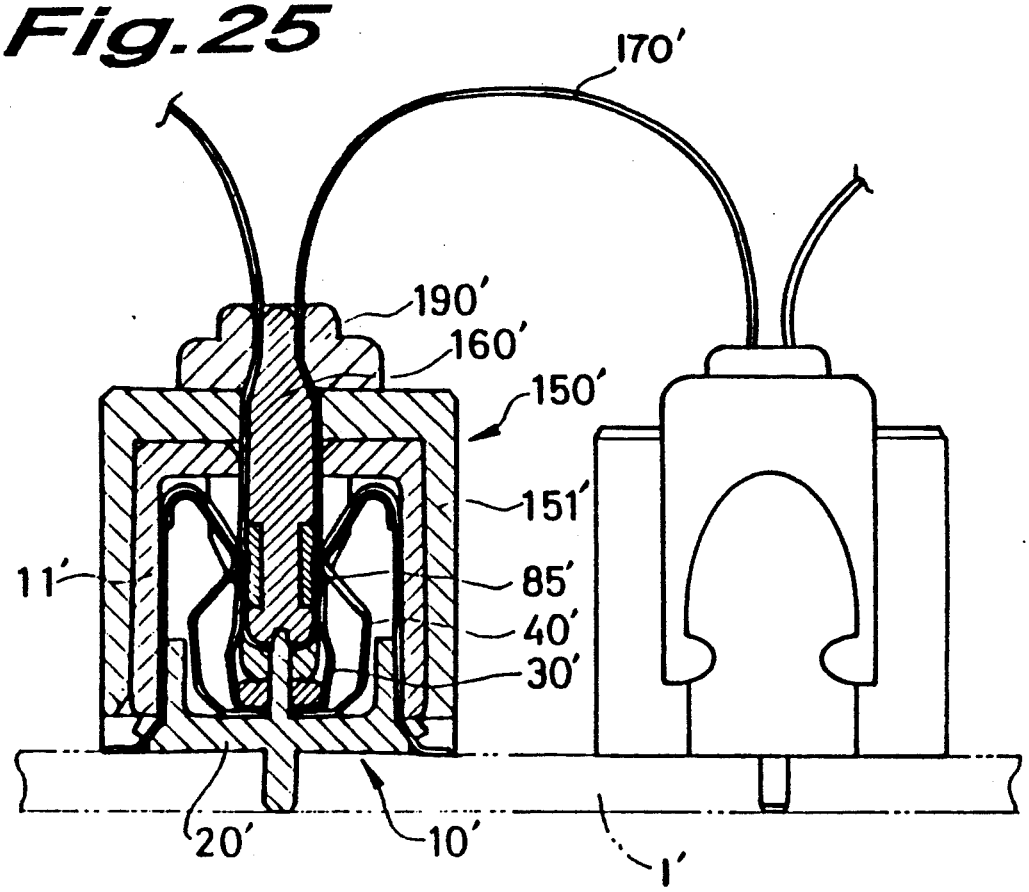
FIG. 25 is a schematic cross-sectional and end elevational view of connector assemblies according to FIG. 16(*a*), linked together daisy-chain fashion.

This embodiment is suitable for connection to other connectors e.g., daisy-chaining, as shown in FIG. 25, in which primed reference numerals indicate elements corresponding to those of FIGS. 15–17.

Figure 18:
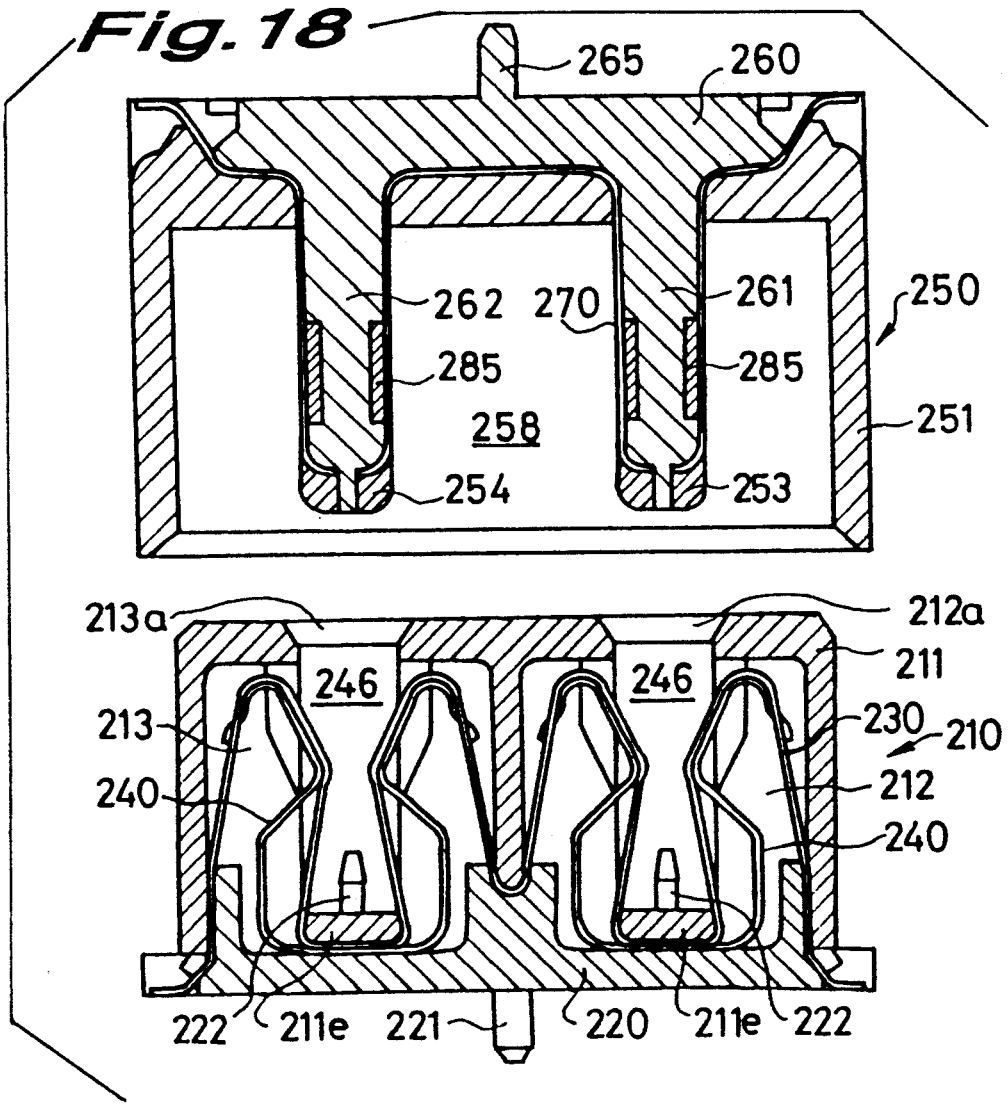
FIG. 18 is a cross-sectional view of further embodiments of plug and receptacle connectors aligned for mating.
Figure 19:
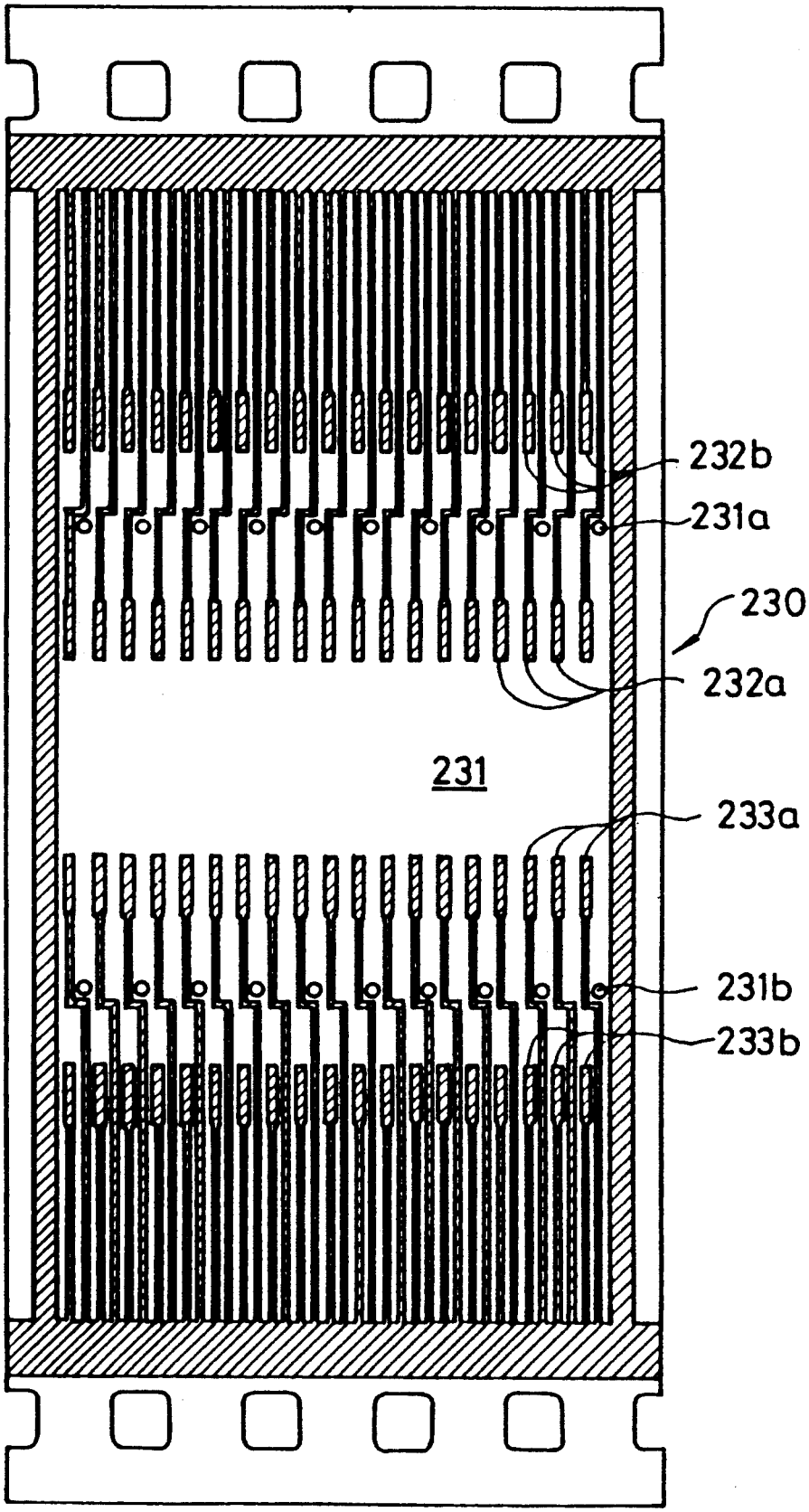
FIG. 19 is a plan view of a precursor flexible circuit for use in the connectors of FIG. 18.
Figure 20:
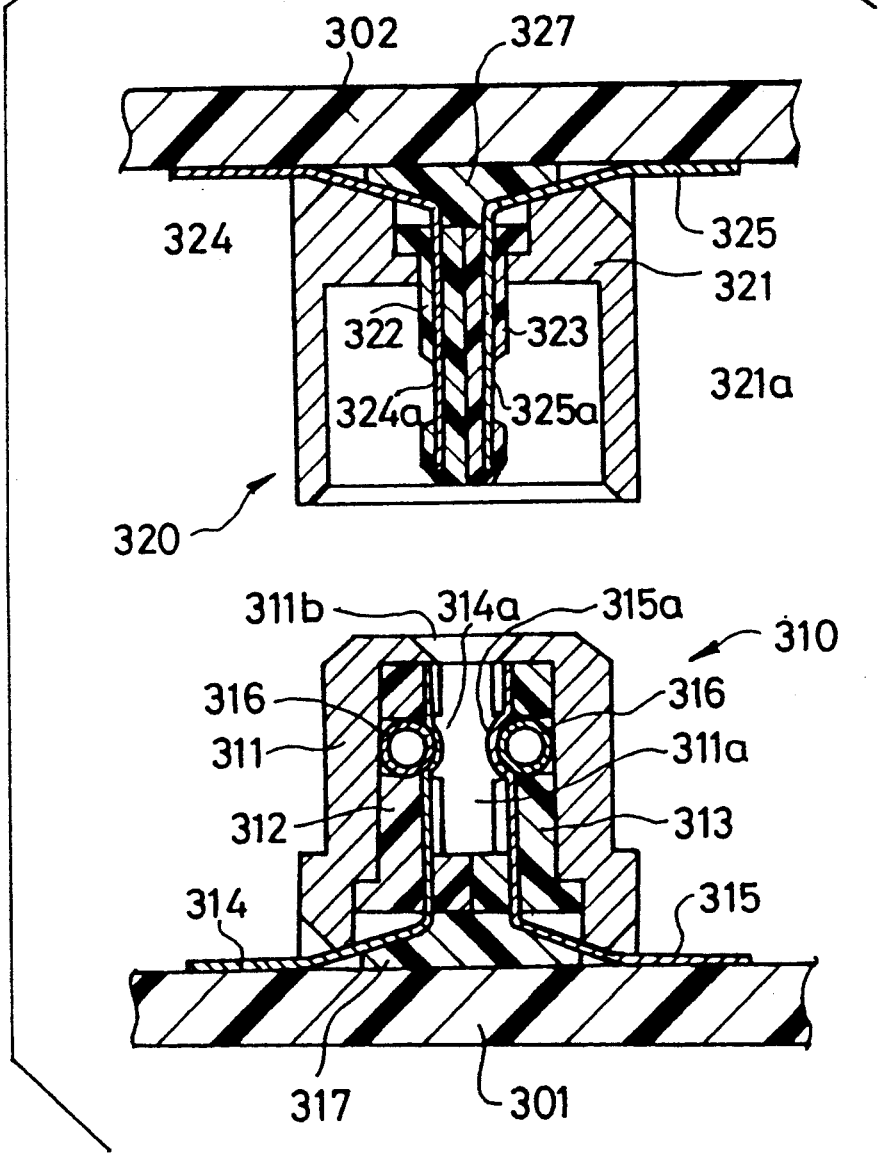
FIG. 20 is a cross-sectional view of plug and receptacle connectors described in the parent application.

As shown in FIGS. 18 and 19, a further embodiment incorporates two channel section receptacle springs and two plug-like film circuit supporting members arranged in side-by-side relation in respective plug and socket housings which are otherwise similar to the first example.

In essence, the receptacle connector 21 is equivalent to two connectors of the first example sharing a common medial wall and comprises a housing 211 defining two plug receiving cavities 212 and 213 having slotted plug receiving mouths 212*a* and 213*a*, respectively, at a mating face. A pair of film circuit locating ribs 211*e* extend between end walls of respective cavities. The receptacle spring mounting member 22 has two receptacle spring locating portions in respective cavities and locating respective channel section receptacle springs 240.

The flexible circuit precursor 230 has two sets of conductive tracks 232*a*, and 232*b* and 233*a*, 233*b*, respectively, on opposite side portions of an insulating web, each having enlarged mating contact areas located on respective opposite sides of rows of medial locate retaining apertures 231*a* and 231*b*, respectively.

Respective film circuit portions respective sets of conductive tracks are located by pushing into respective receptacle springs and retained therein by the receipt of guide pins 222 and retention pins (not shown) in respective apertures, in other respects being assembled in the receptacle housing in a similar fashion to the first example except that, an insulating web portion joining the two sets of conductive tracks extends between the two cavities clamped between a lower edge of the rebated wall and a clamping projection upstanding from the receptacle spring mounting member at a central location.

The plug connector 250 comprises an outer housing 251 defining a receptacle receiving cavity 258 opening to a mating face, a single film circuit supporting member 260 having a pair of bridging portions 253, 254 upstanding in side-by-side, parallel relation aligned over respective slotted apertures in a transverse base wall. A pair of film circuit supporting walls 261 and 262 upstand in side-by-side parallel relation from a common foot. Each film circuit supporting wall is formed with a groove receiving a resilient compression spring 285, similar to that of the first example. The film circuit is similar to that of FIG. 19 and installed in a similar manner to the installation of the first example with respective mating contact areas 232*a, b* and 233*a, b* overlying the compressible springs 285 and a joining web portion clamped between the foot of the film circuit supporting member and the base wall.

Figure 21:
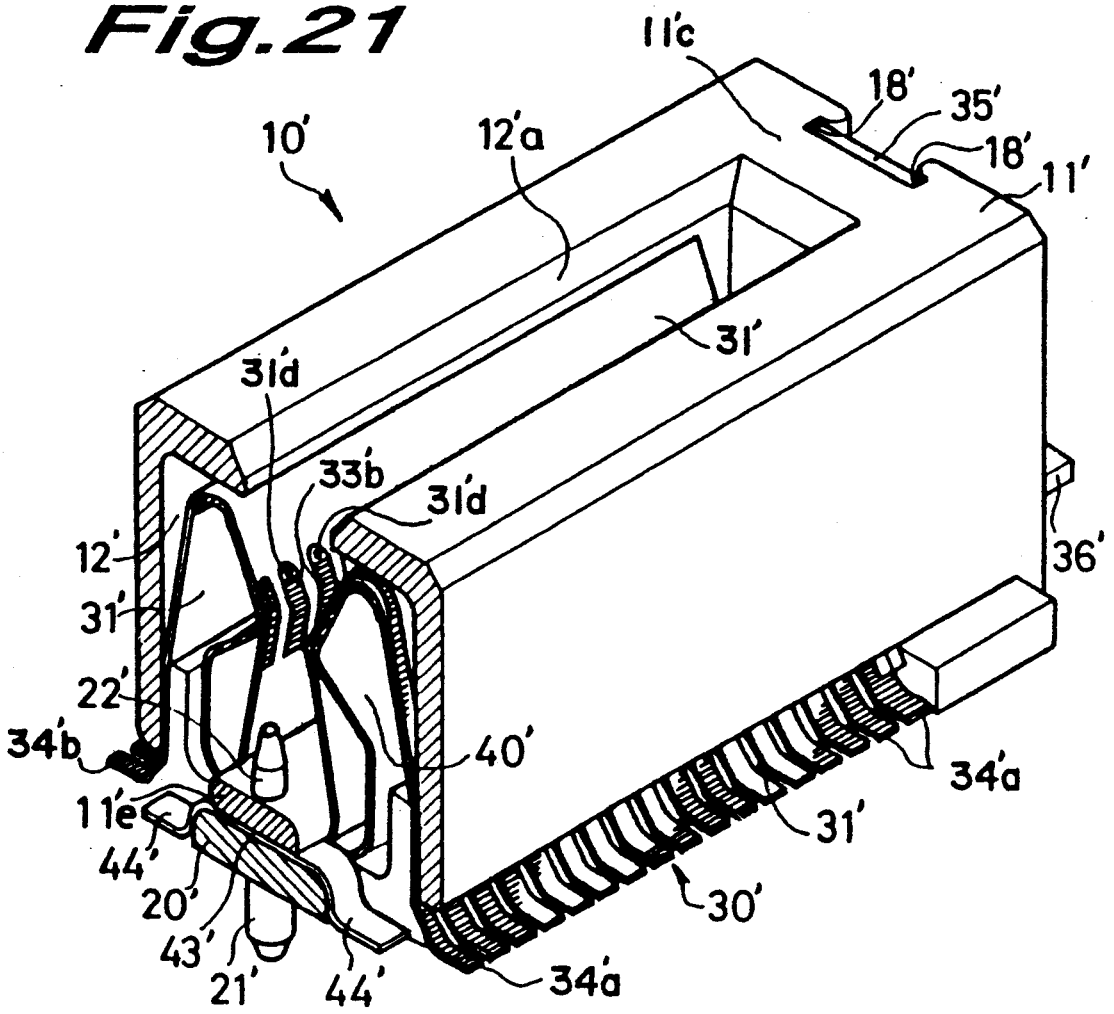
FIG. 21 is a perspective view, partly in cross section, of another embodiment of receptacle connector incorporating modified film circuitry.
Figure 23:
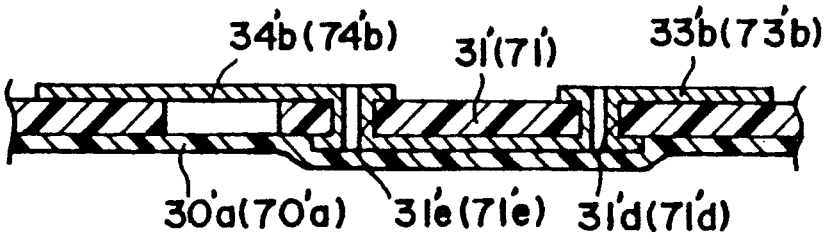
FIG. 23 is a fragmentary cross-sectional view of the modified film circuitry.
Figure 22:
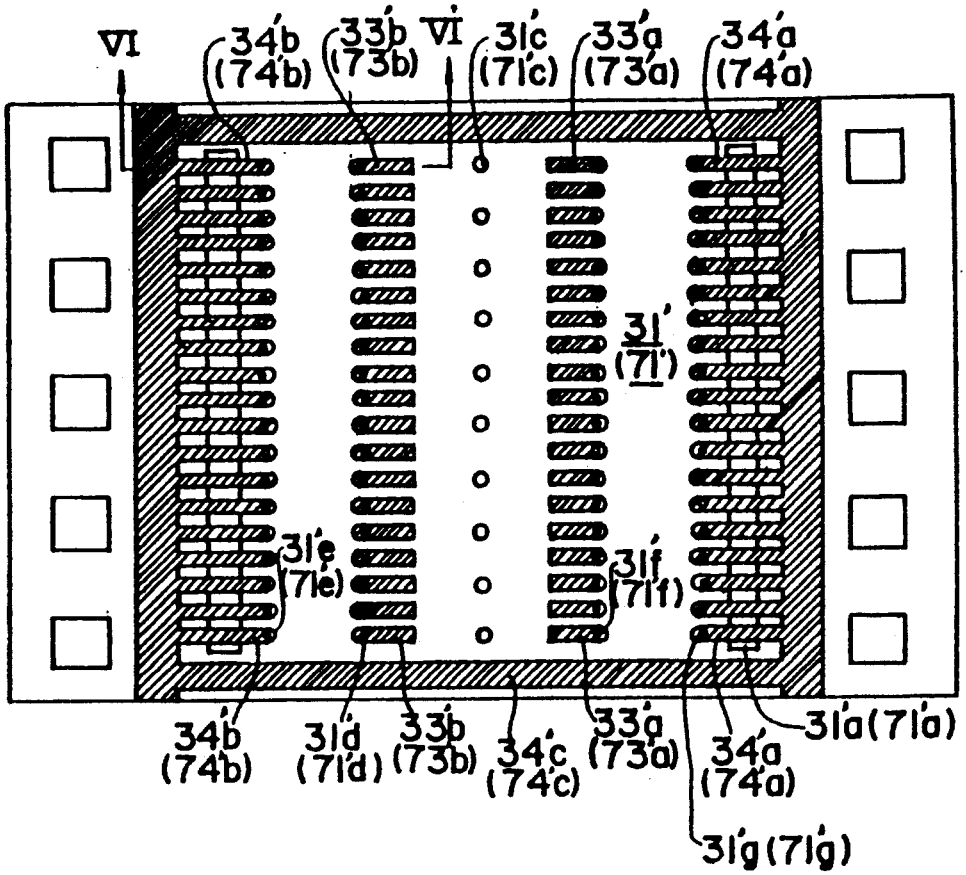
FIGS. 22(*a*) and 22(*b*) are front, plan and rear, underplan views of mating contact and rear faces of a modified film circuit for use in the connector.
Figure 22:
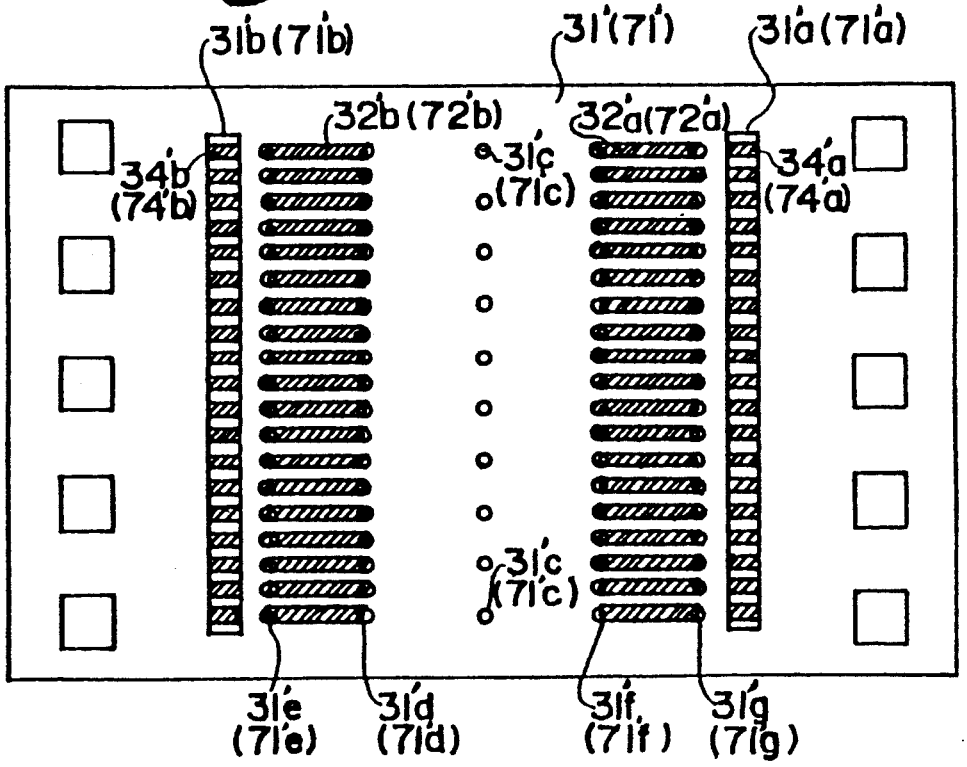
Figure 24:
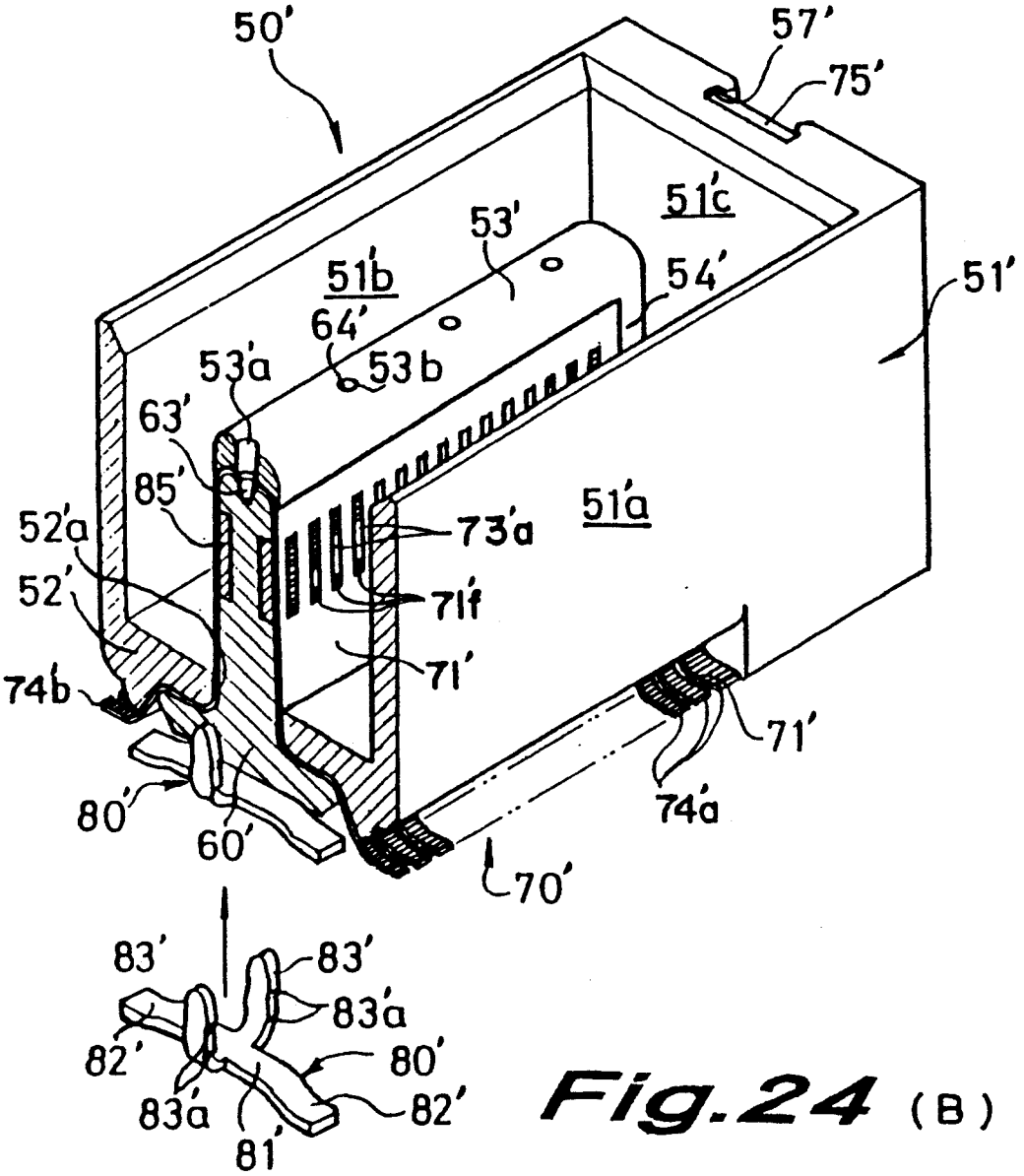
FIGS. 24(*a*) and 24(*b*) are perspective views, partly in cross-section of a further embodiment of receptacle connector incorporating film circuitry modified in a fashion complementary to that of FIG. 21.

The connector assembly of FIGS. 21 and 24 incorporates a film circuit, the precursor of which is shown in FIGS. 22*a*, 22*b* and 23 and in which different portions of conductive track extend across opposite faces of an insulated web for protection and insulation thereof.

Figure 30:
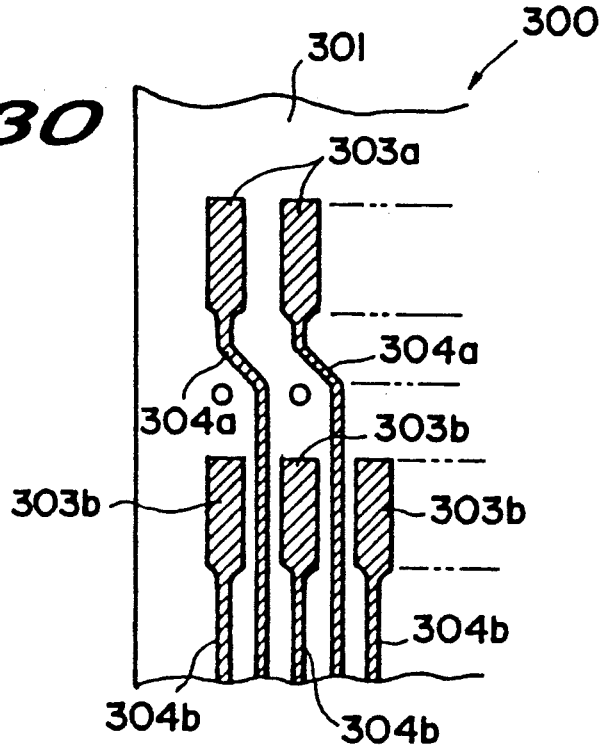
FIG. 30 is a fragmentary plan view of a prior film circuit.

The film circuit of the invention may be contrasted with the prior art as shown in FIG. 30 in which rows of mating contact conductor portions 303*a*, 303*b* are joined by linking conductor portions 304*a*, 304*b* which are on the same or common, front mating face of the web 301.

In particular, in the receptacle connector shown in FIG. 21 in which primed reference numerals indicate similar parts to the connector receptacle of the first example, the conductive tracks have mating contact portions 33'*a* and 33'*b* formed on the front mating face of the web 31' extending in respective rows away from circuit locating apertures 31'*c* on a medial portion of the web and which are connected by plated through-holes 31'*f* and 31'*d* to respective adjacent ends of linking or wiring conductive tracks 32'*a*, 32'*b* on the rear surface of the web 31'. The other ends of the linking conductive tracks 32'*a*, 32'*b* are connected by plated through-holes 31'*g* and 31'*e* to respective board connecting portions 34'*a*, 34'*b* of the conductive tracks which extend across respective windows exposing them to a circuit board. An insulating coating 30'*a* covers the linking conductive tracks 32'*a*, 32'*b* for use when the spring is metal.

As in the previous example, portions of the precursor of the film circuit including the outer conductive tracks 34*c* and associated with indexing holes are removed before assembly in the connector housing.

As can be seen in FIG. 21, the mating contact portions 33'*b* overly the protruberances but the linking portions 32'*b* do not contact those of the plug connector on mating but will be protected from possible abrasion or peeling on mating in advance of the contact area which could otherwise possibly be caused by a high frictional mating force. The linking portions will also be insulated from the spring by the insulating layer 30'*a* and concealed from contact with any worm metal particles or powder inadvertently accumulated on the front face of the film which could cause a short circuit between the conductive tracks. Tips of board connecting portions 34'*a*, 34'*b* extend out of the housing separated and exposed at the board connecting face.

As the plug connector of FIG. 24 is similar to that of FIG. 9 (and FIG. 12), primed reference numerals have been used to indicate corresponding paths. The film circuit thereof is essentially similar to that of FIGS. 22*a* and 22*b* although differing in size, corresponding parts being indicated by series 70 reference numerals.

As stated above, FIG. 25 shows a connector similar to that of FIG. 17 but connected to an identical connector by film circuit in daisy-chain fashion. Primed reference numerals are used to indicate similar parts.

Figure 26:
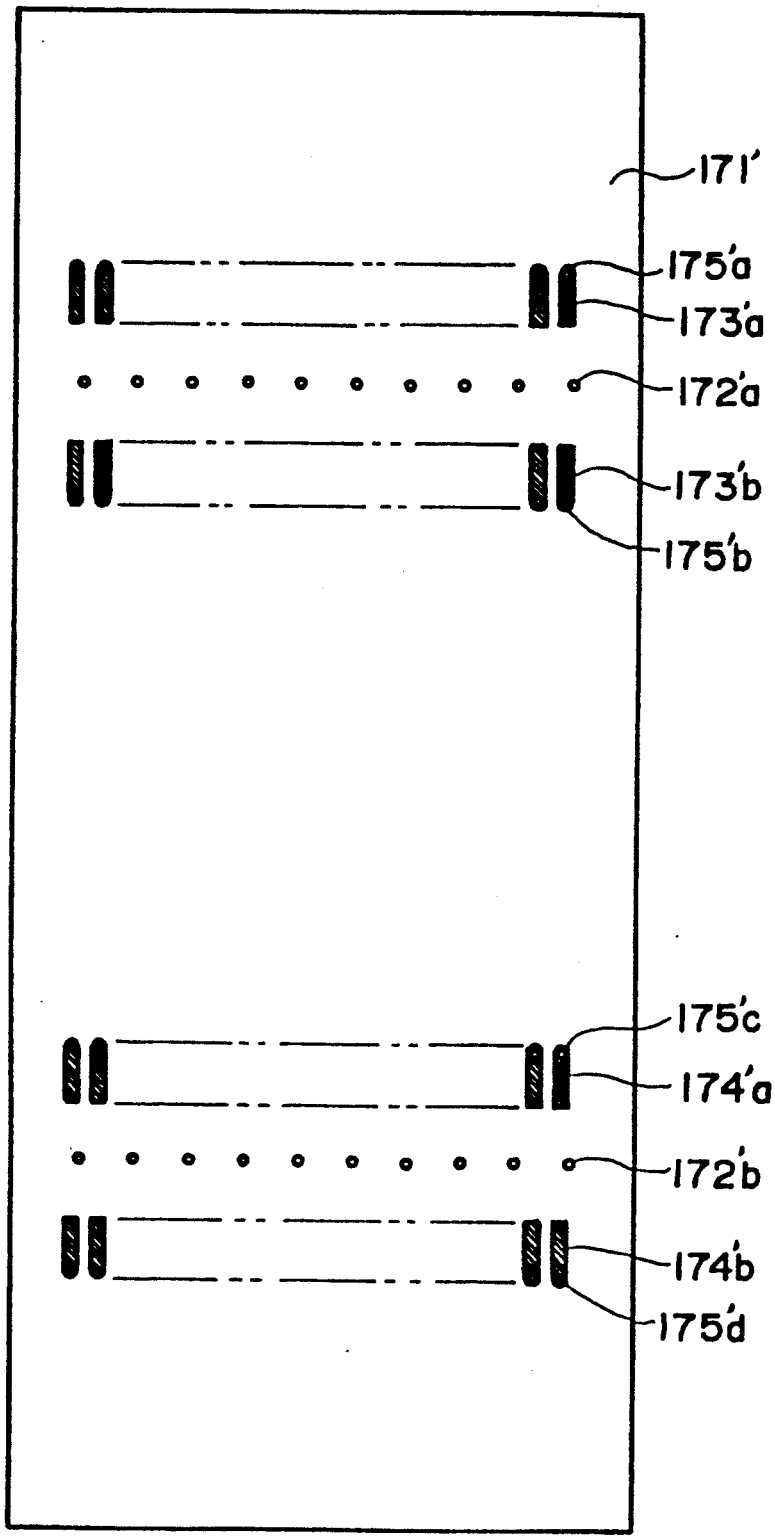
FIGS. 26 and 27 are a plan of front, mating contact face and an underplan view of the rear face of film circuits incorporated in the connector assembly of FIG. 25.
Figure 27:
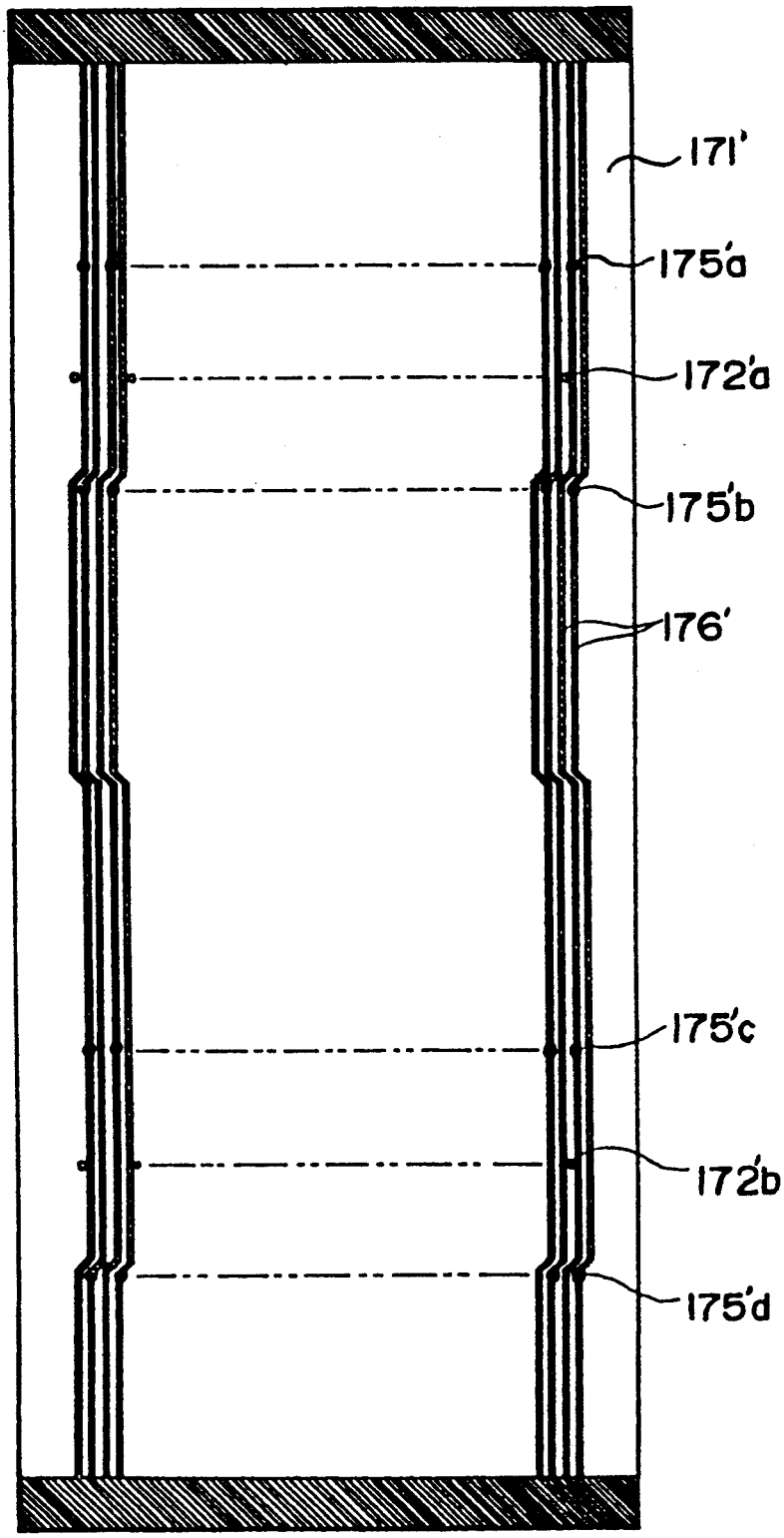
Figure 28:
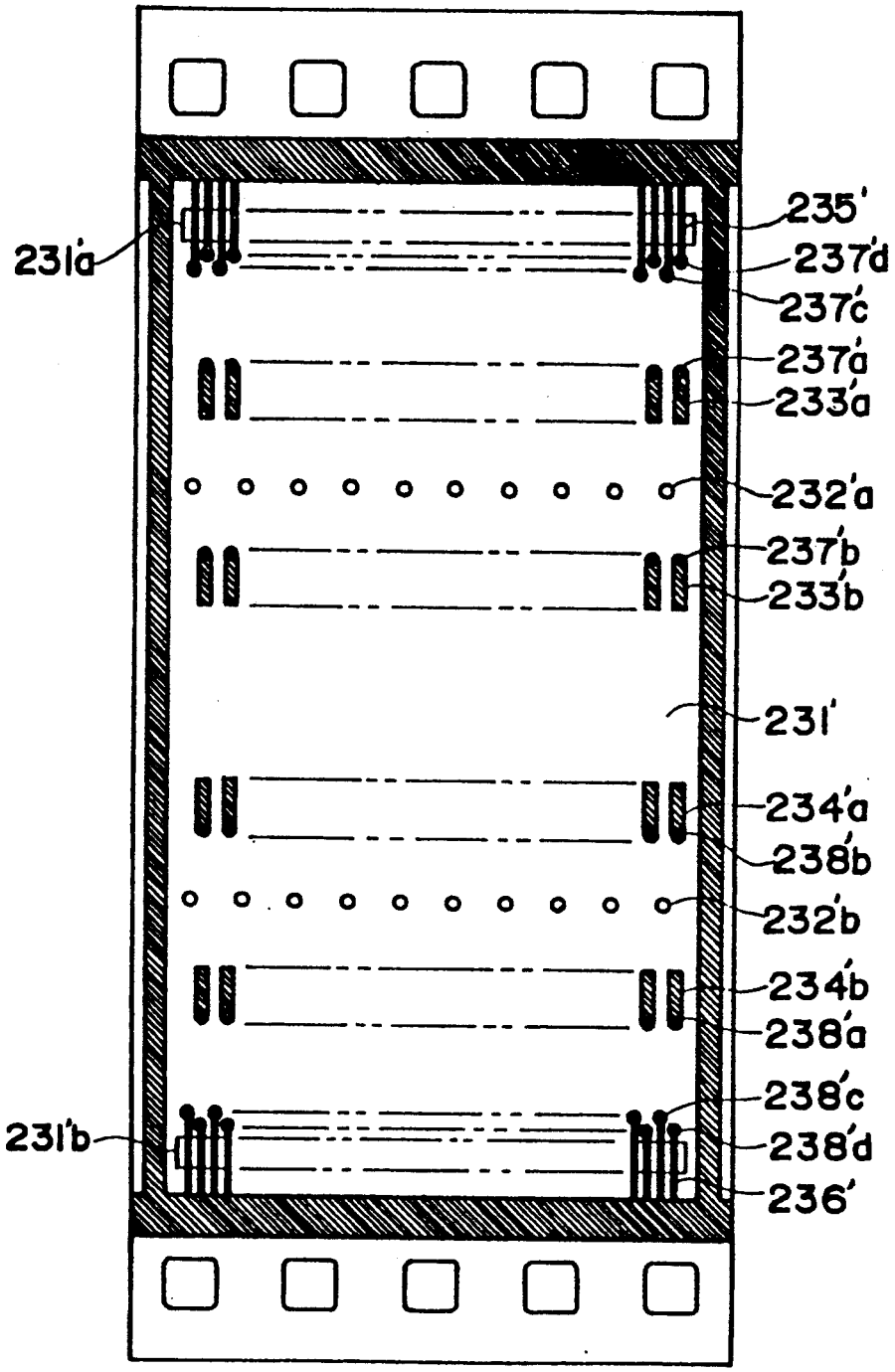
FIGS. 28 and 29 are plan views of the front, mating contact faces and the rear faces of a film circuit incorporated in the embodiment of FIG. 18.
Figure 29:
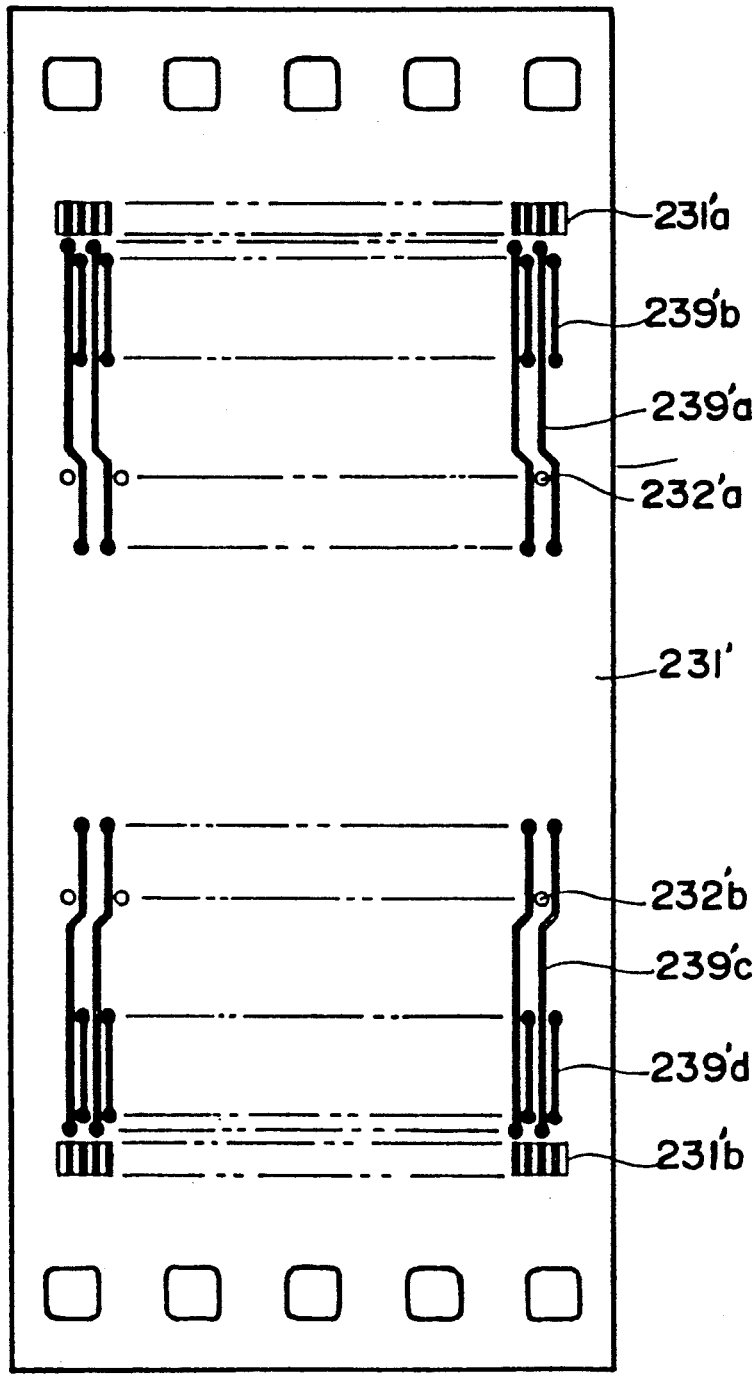
Figure 31:
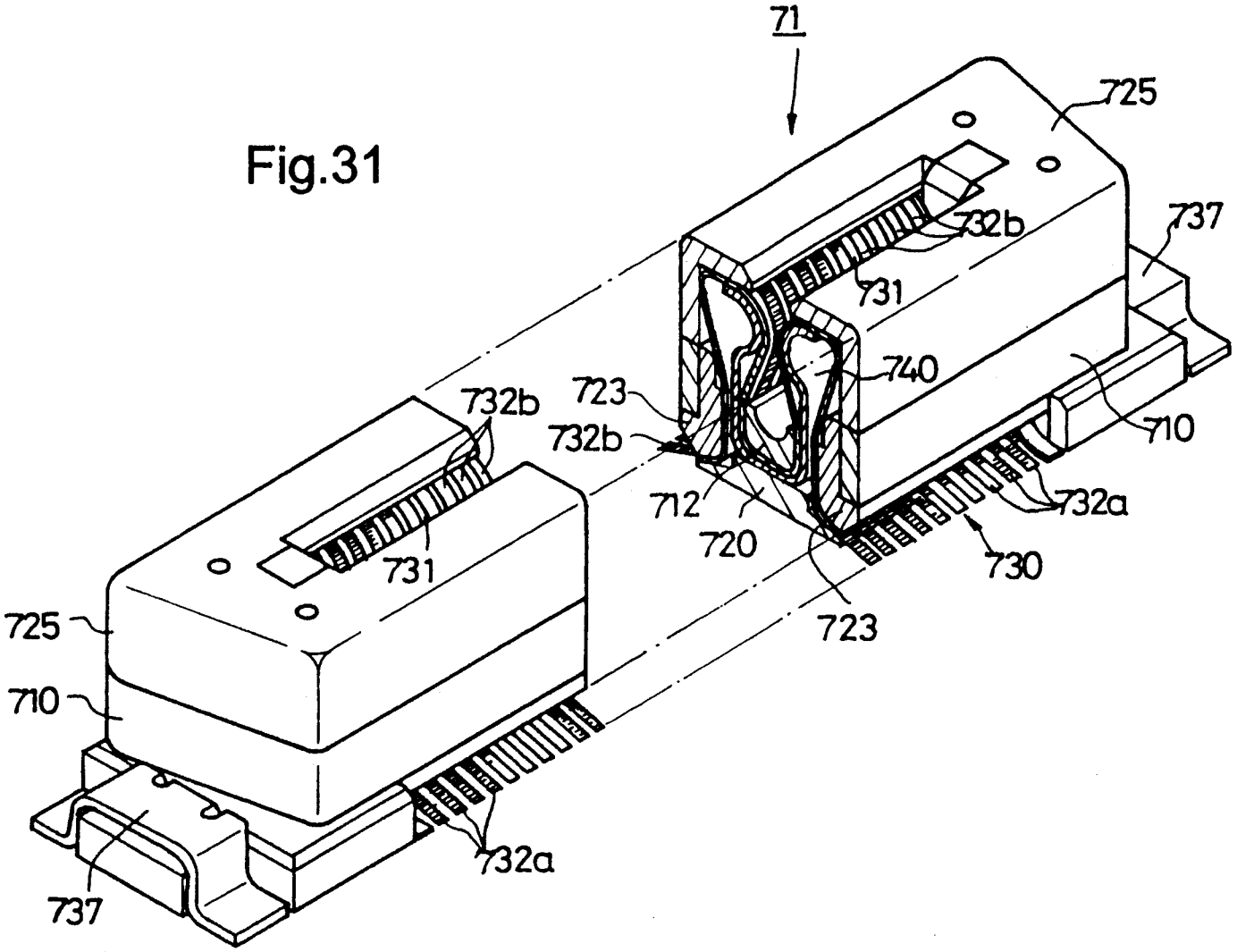
FIG. 31 is a perspective view, partly in cross-section of a further embodiment of receptacle connector according to the invention.

As shown in FIGS. 26 and 27, the film circuit precursor 170 has four rows of mating contact conductive track portions 173'*a*, 173'*b* and 174'*a*, 174'*b* arranged as two pairs with individual rows of each pair on respective opposite sides of apertures 172'*a* and 172'*b* on a front mating face of the web, each conductive track being connected to respective linking portions 176' on the rear face of the web like conductive through holes 175'*a*–175'*d*, respectively.

In another embodiment, the precursor of the film circuit shown in FIGS. 26 and 27 for a connector similar to that shown in FIG. 18, the rows of each pair of two pairs of rows of mating contact portions of conductive tracks 233'*a*, 233'*b* and 234'*a*, 234'*b* on the front, mating face of web 231' and on respective opposite sides of locating apertures of 232'*a*, 232'*b*, are connected by conductive through-holes 237'*a*, 237'*b*, and 238'*b*, 238'*a* to linking conductor portions 239'*b*, 239'*a* and 239'*c*, 239'*d*, respectively, on the rear face of the web, themselves connected by conductive through-holes 237'*d*, 237'*c* and 238'*c*, 238'*d*, respectively, to board connecting portions 235' and 236' exposed at windows 231'*a* and 231'*b*. As before, the outer conductor and associated web portions are cut away when mounting the film circuit in the connector. As As shown in FIGS. 31–40, the receptacle connector 701 includes an outer housing comprising a sleeve-form main body 710 and a cover member 725, film positioning and clamping members 723, a channel-section receptacle spring 740 and a film circuit 730.

Figure 4:
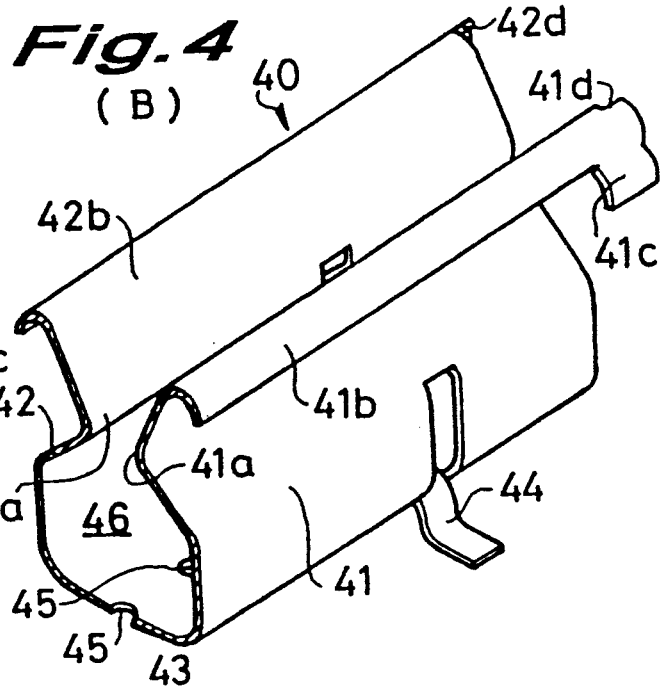
FIGS. 4(*a*) and 4(*b*) are, respectively, end elevational and perspective views, partly in cross-section, of a channel-section receptacle spring of the first example of receptacle connector.
Figure 4:
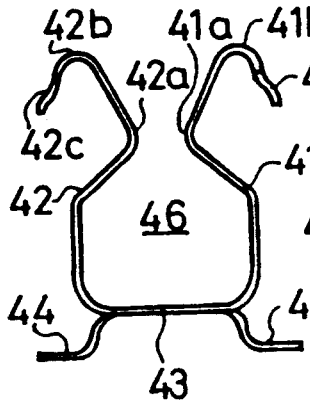
Figure 3:
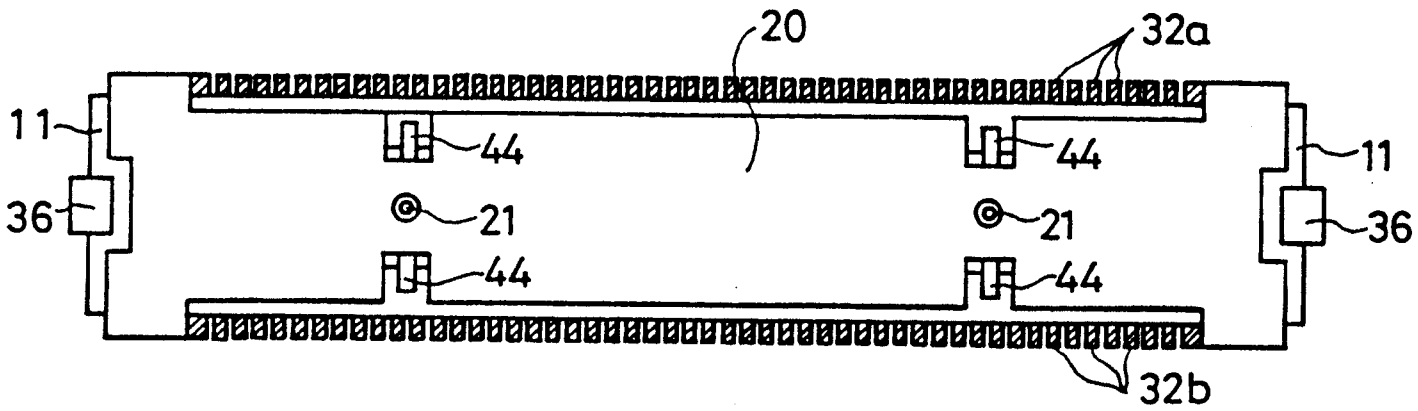
FIG. 3 is an underplan view of the first example.

The main body 710, shown, more particularly in FIG. 4, is molded in one piece of suitable insulating plastic material and comprises a generally rectangular sleeve-form frame structure having opposed longitudinal side walls 711*a* and 711*b* joined by end wall portions 711*d* and defining a cavity open towards upper, mating and lower faces. An elongate rib 712 extends centrally of the body adjacent the lower face forming two apertures 710*a* and 710*b* at the lower face on respective opposite sides of the rib. The rib is formed with a series of guide pin receiving apertures 712*b* at predetermined intervals therealong and has a concave upper surface 712*a*.

Receptacle spring prestressing columns or pillars 713 of rectangular section upstand from opposite longitudinal ends of the rib at locations adjacent the ends of the body. Rectangular section spring locking sockets 715 having upwardly and inwardly tapering walls 15*a* culminating in upwardly facing latching shoulders are formed of each side of the socket 715. Film circuit supporting member anchoring socket 718 are also formed in a lower face and cover housing guiding and film circuit locating and locking projection 714 are formed on an upper face, both sockets and projections being on each side of the columns 713.

Circuit board anchoring posts 717 depend from feet 716 at respective opposite ends of the housing maintaining the side walls (in effect rebated) spaced above the circuit board. Locking sockets 16*a* are formed in each foot and looped stamped and formed metal mounting members 737, shown in FIGS. 35*a* and 35*b*, have anchoring tabs 739 with tangs 739*a* mounted therein with loop portions 736 trapping longitudinal extensions of the housing against the circuit board with under surfaces 738*a* of solder tab portions 738 soldered to the circuit board.

As shown in FIG. 39, the cover housing 725 has an upper wall 727 and opposite side and end walls 726*a*–*d*. The upper wall has a slot-form plug receiving mouth 727*a* and downwardly opening sockets 727*b* located at each corner thereof for receipt of locking projections 714 of the main body.

The receptacle spring 740 has channel side walls 741 upstanding from a base 743 defining a plug receiving face 748 therebetween. The side walls are formed with inwardly convex protuberances 741*a*, 742*a*, transversely bent upper end portions 741*b* and 742*b* from longitudinal extensions of which depend cam following projections 744. Latching posts with spring portions 745 at upper ends upstand from longitudinal extensions of each end of the base. A row of four apertures 747 are formed to extend along each side wall.

Anchoring and board connecting tabs 746 are struck out from respective opposite side walls and extend downwardly and inwardly for anchoring and electrical connection to a circuit board for mounting and shielding purposes.

As shown in FIG. 36, each film positioning and clamping member 723 is of L-section and formed with press-fitting projections 723*a* at respective ends and a land 723*c* with a film circuit engaging face 723*b*.

As shown in FIG. 37, the base member 720 is an elongate strip with raised end portions 721 and a raised central, supporting portion 720*a* from opposite longitudinal sides of which portions 720*b* taper to a circuit board engaging face. Two longitudinally spaced apart windows 722 for admitting tabs 746 of the receptacle spring are also formed therein.

Figure 40A:
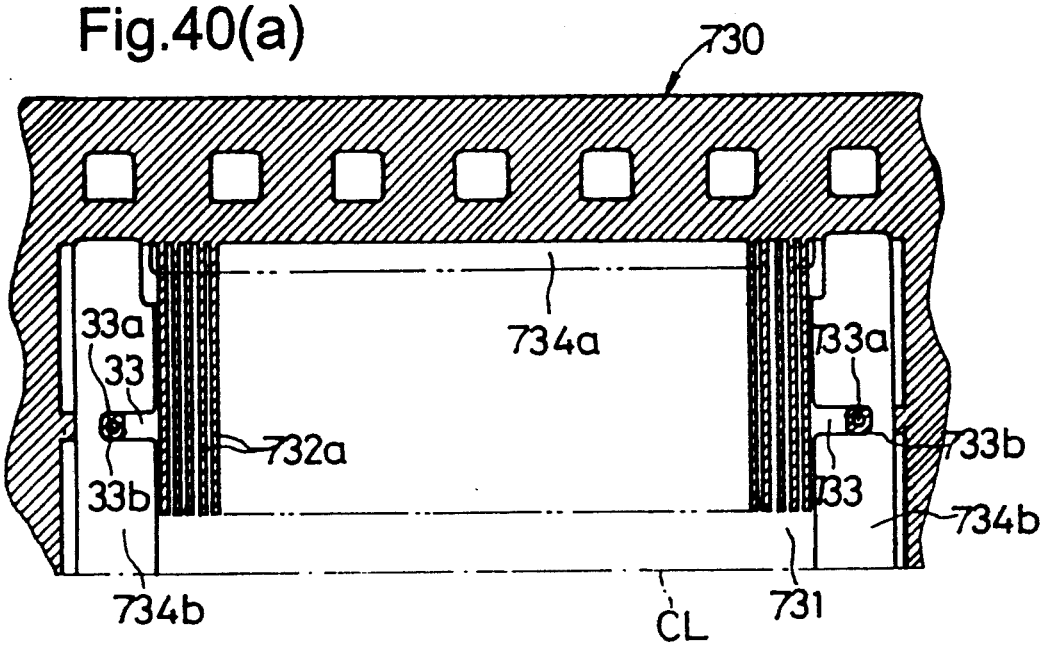
FIGS. 40(*a*) and 40(*b*) are plan and underplan views showing the front, mating and rear faces, respectively, of a film circuit of the receptacle connector of FIG. 31.
Figure 40B:
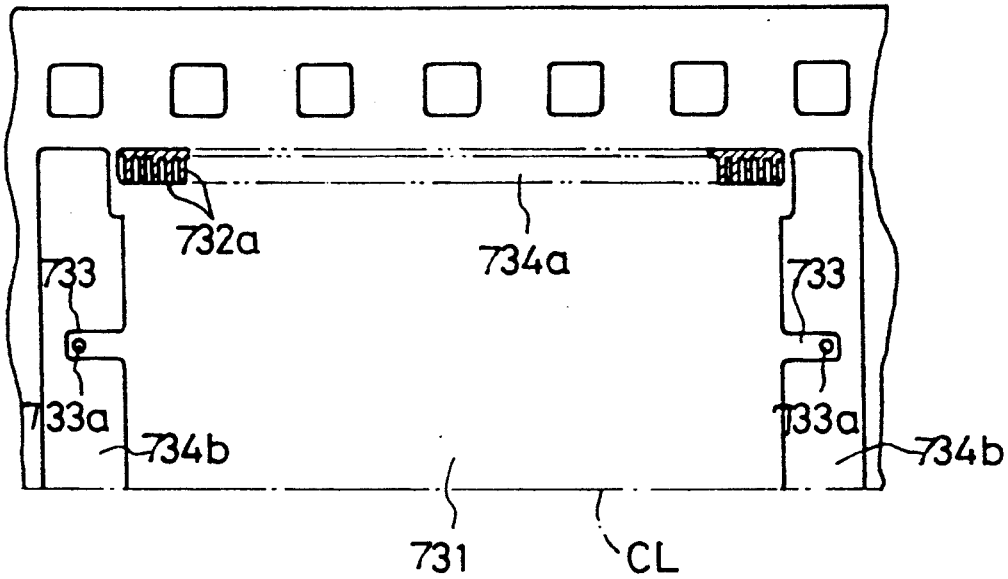
Figure 41:
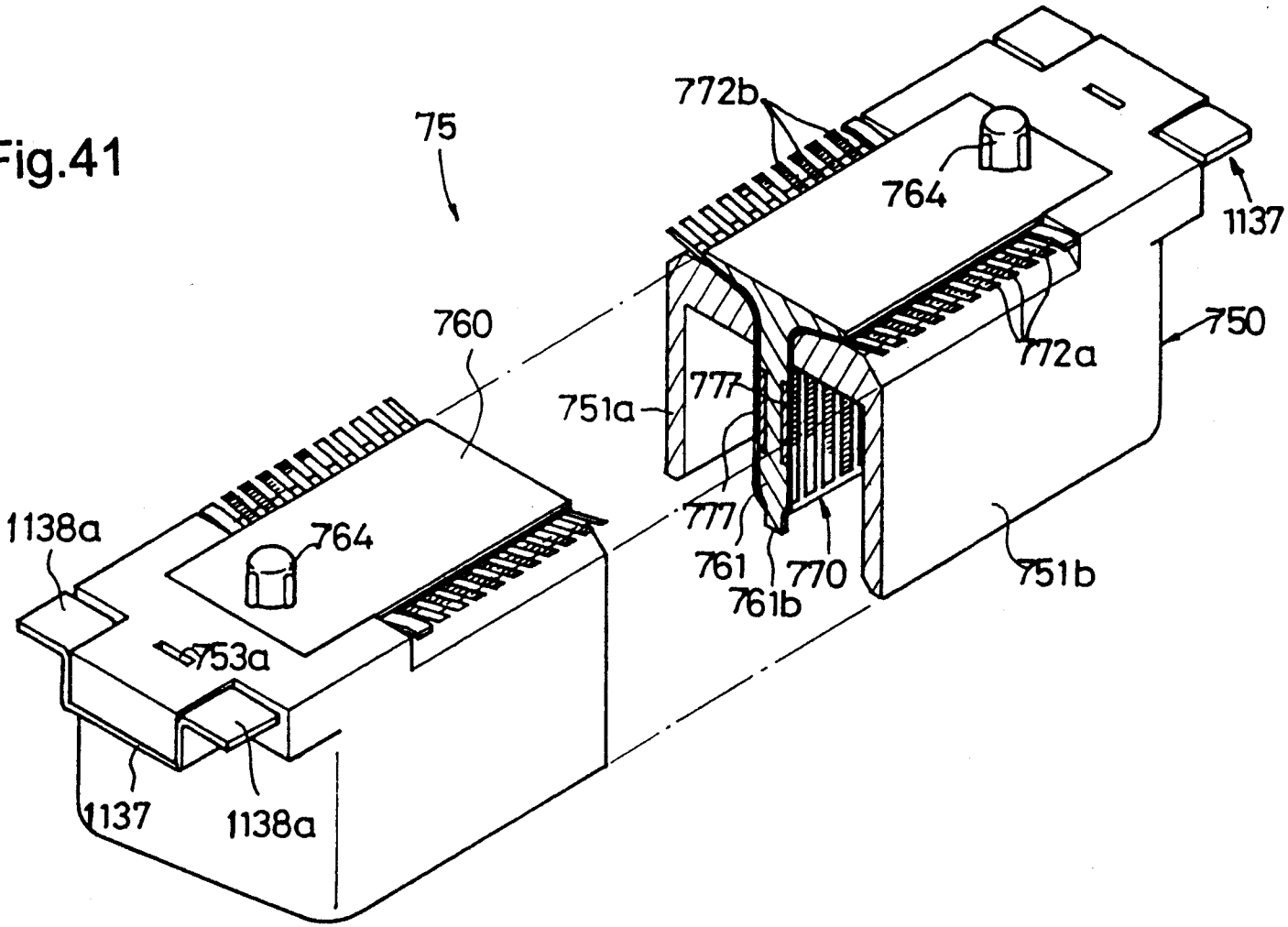
FIG. 41 is a perspective view, partly in cross-section of a plug connector for mating with the receptacle connector of FIG. 1.
Figure 42A:
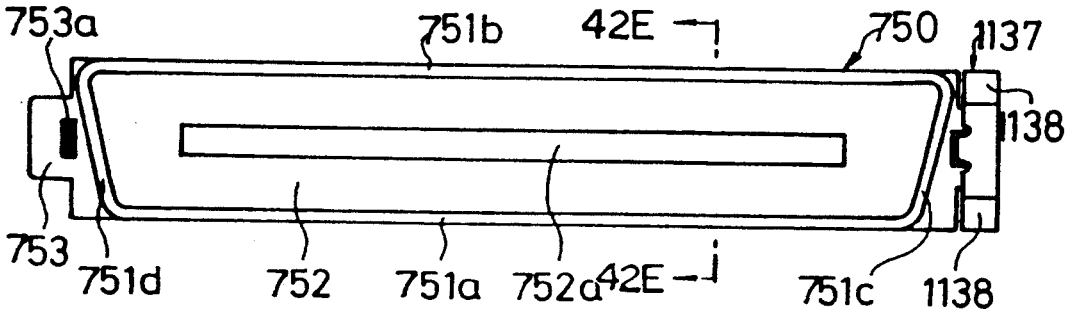
FIGS. 42(*a*)–42(*e*) are, respectively, plan, side elevational partly in cross-section, underplan, end elevational and cross-sectional views of an outer housing of the plug connector of FIG. 41, the cross-section being taken along line 42*e*—42*e* of FIG. 42(*a*)
Figure 42B:
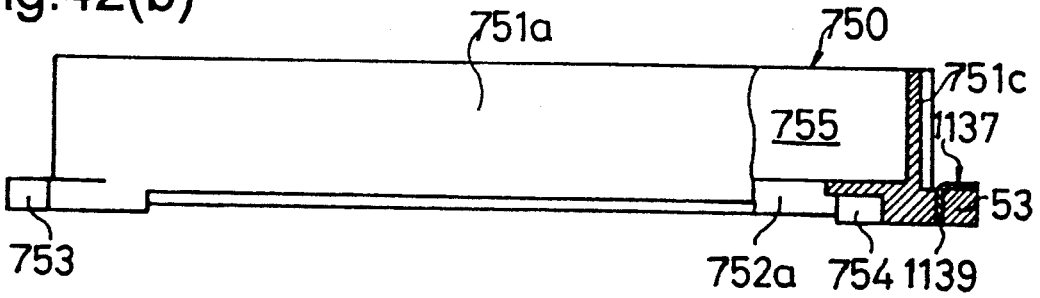
Figure 42C:
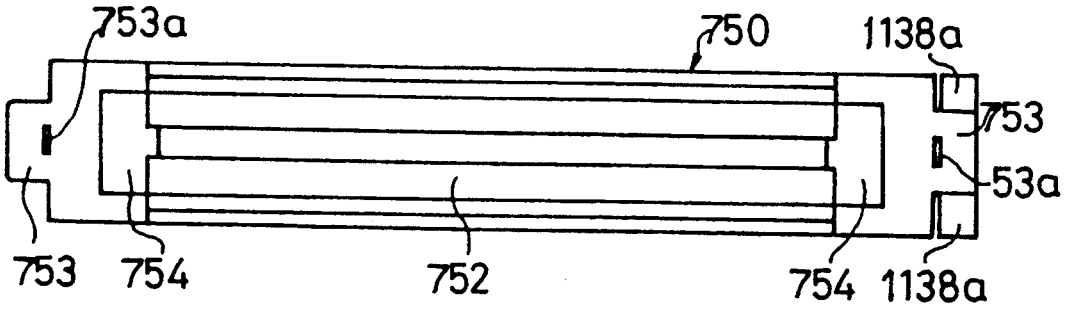
Figure 42D:
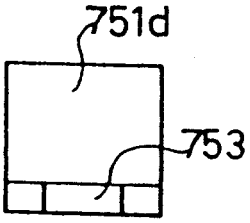
Figure 42E:
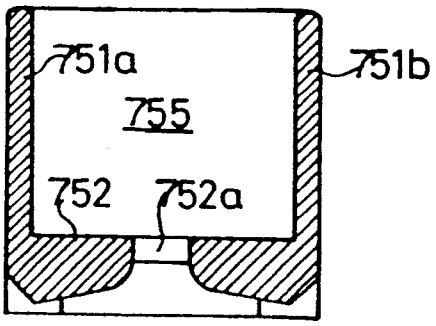
Figure 43A:
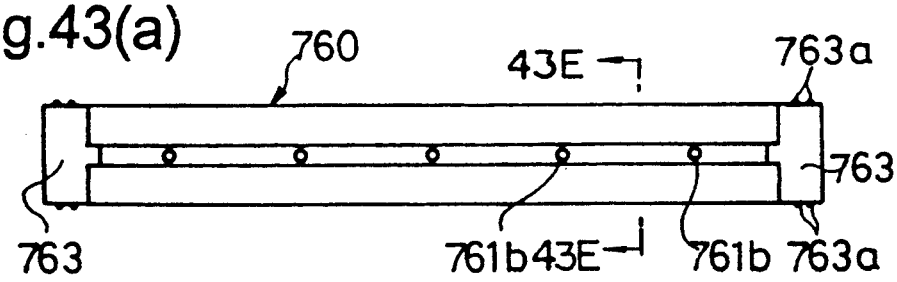
FIGS. 43(*a*)–43(*e*) are, respectively, plan, side elevational, underplan, end elevational and cross-sectional views of a film circuit supporting member of the plug connector of FIG. 41, the cross-section being taken along lines 43*e*—43*e* of FIG. 43(*a*)
Figure 43B:
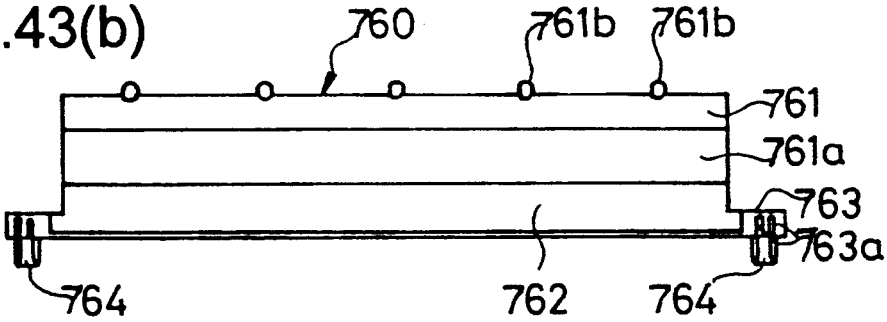
Figure 43C:
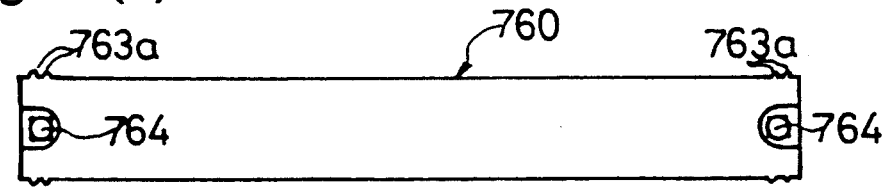
Figure 43D:
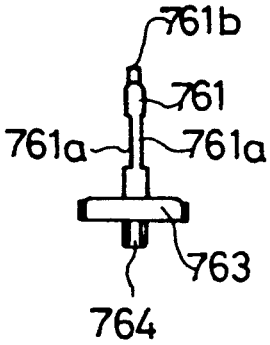
Figure 43E:
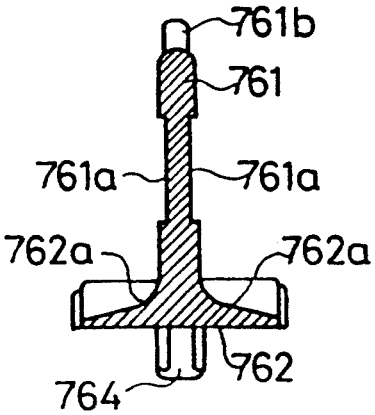
Figure 44A:
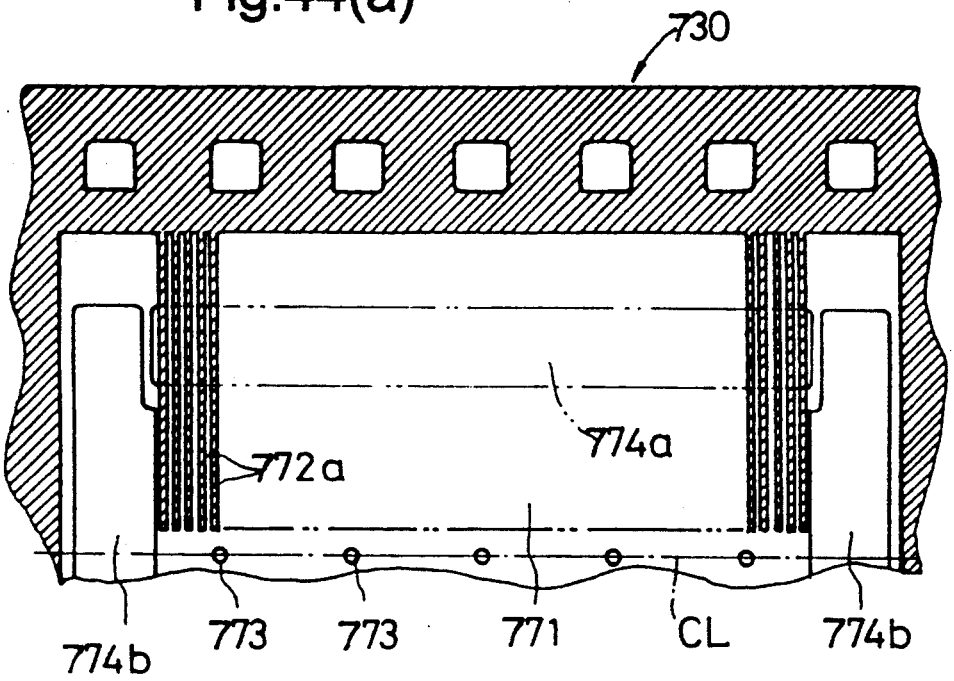
FIGS. 44(*a*) and 44(*b*) are, respectively, plan and underplan views of a film circuit to the plug connector shown in FIG. 41.
Figure 44B:
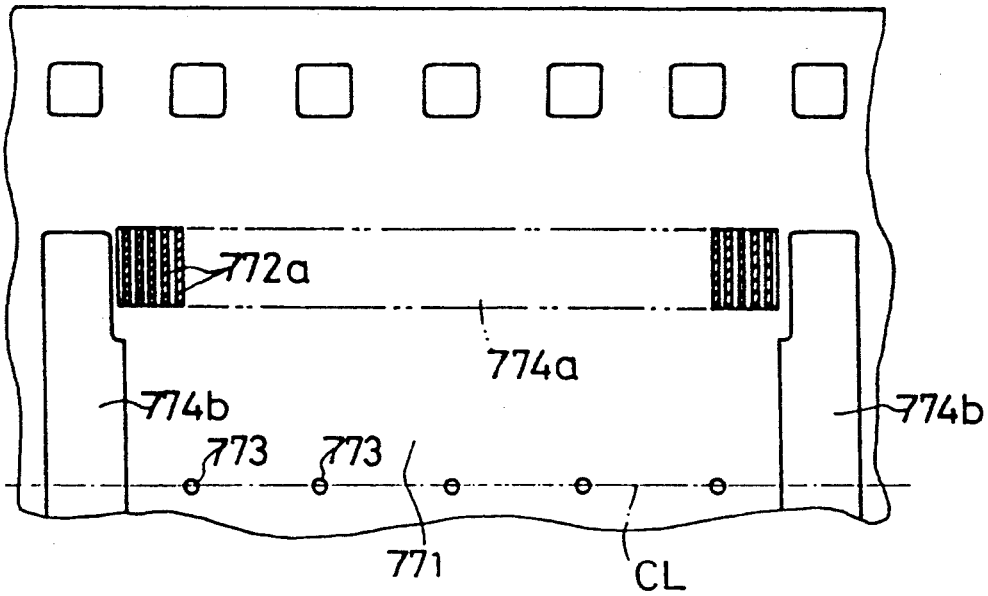
Figure 45:
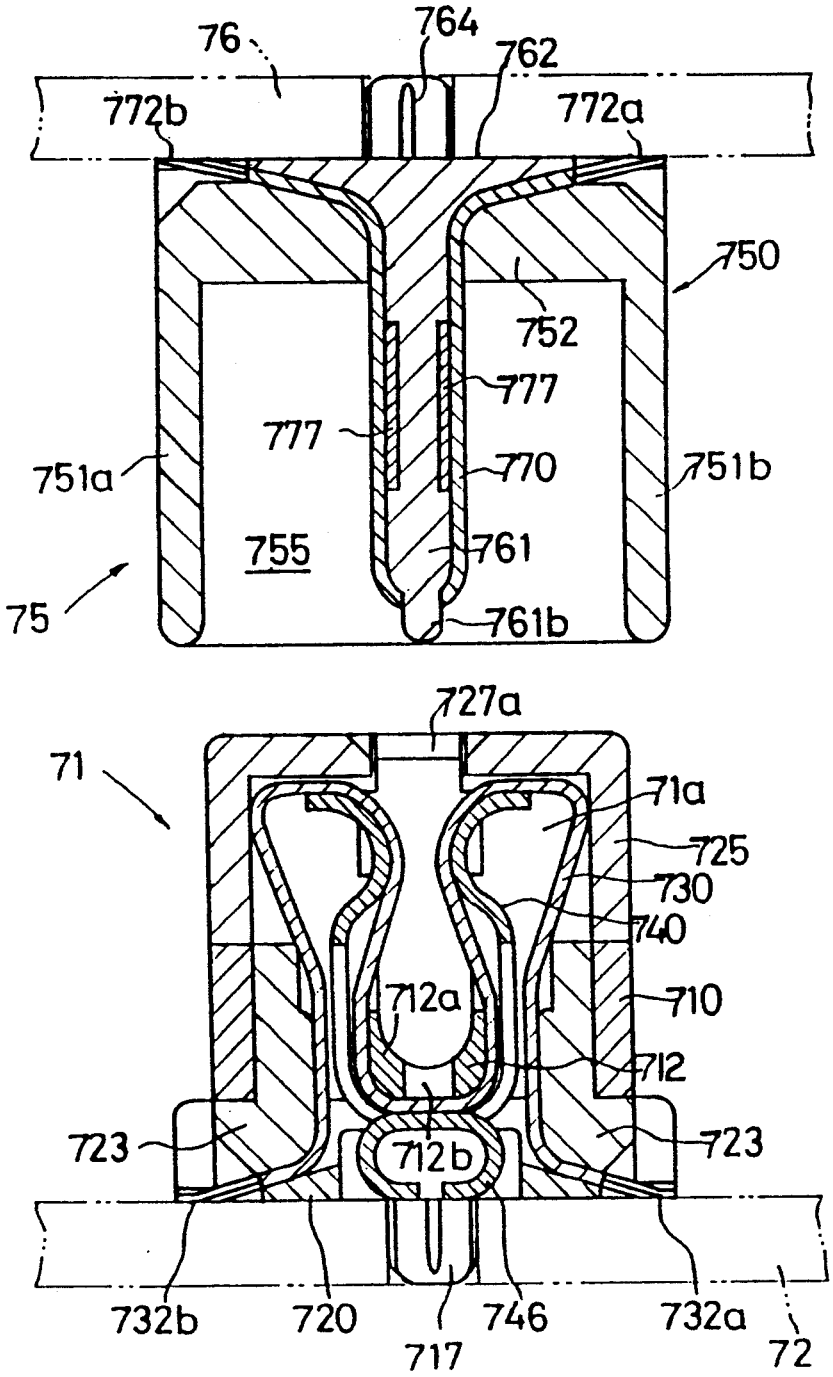
FIG. 45 is a cross-sectional view showing the plug and receptacle connectors of FIGS. 31 and 41 aligned for mating.
Figure 46:
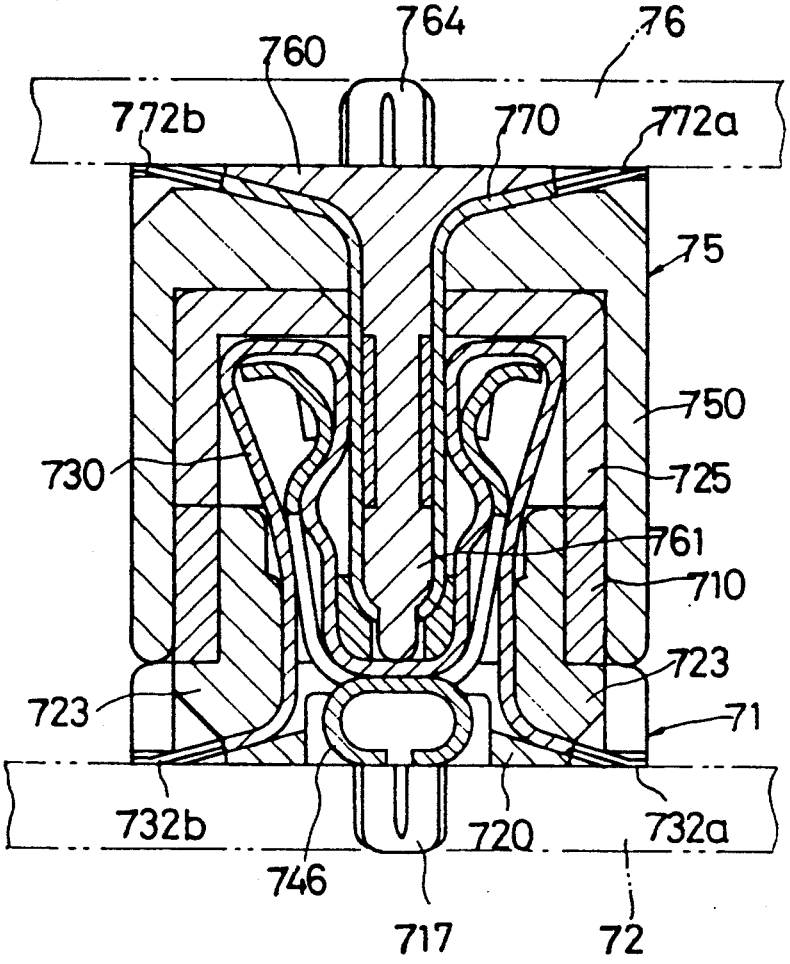
FIG. 46 is a cross-sectional view of the plug and socket connectors fully mated.

The precursor of the film circuit 730 shown in FIG. 40(*a*) and (*b*) is symmetrical on each side of a center line, CL and has conductive paths or tracks 732*a*, 732*b* extending across insulating film or web. Windows 734*a* are cut out at each end to expose board connecting portions of the tracks to a circuit board. Before assembly in a connector, an outer portion of the film circuit is removed in addition to portions 734*b*. Tongue sections 733 remain projecting from respective opposite sides and are each formed with an apertures 733*a* surrounded by a conducting pad 733*d*.

Figure 32:
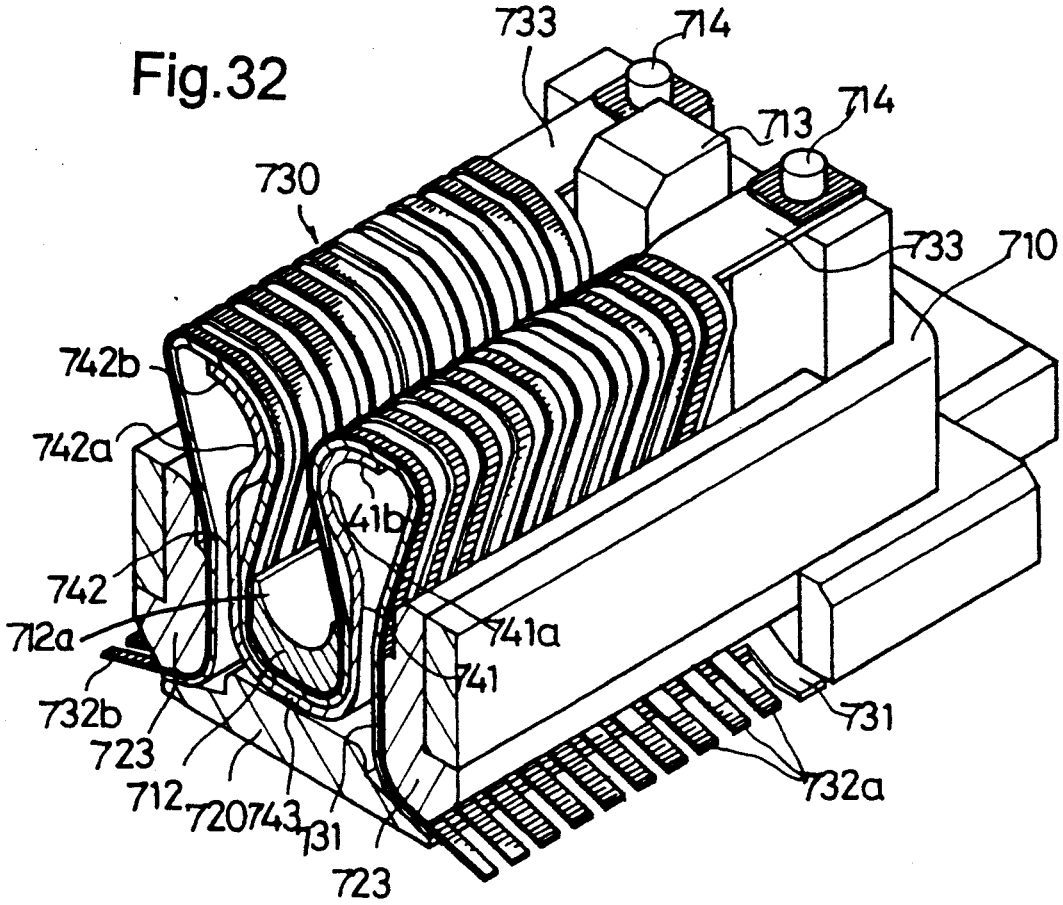
FIG. 32 is a fragmentary perspective view of the receptacle connector shown in FIG. 31 and with a housing member removed.
Figure 33:
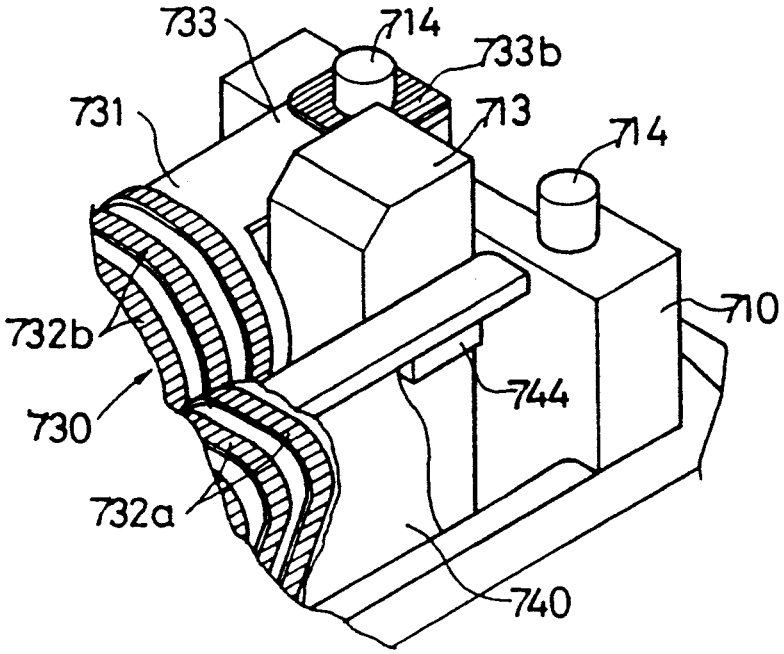
FIG. 33 is a fragmentary perspective view of the receptacle connector of FIG. 32 at an enlarged scale.
Figure 34A:
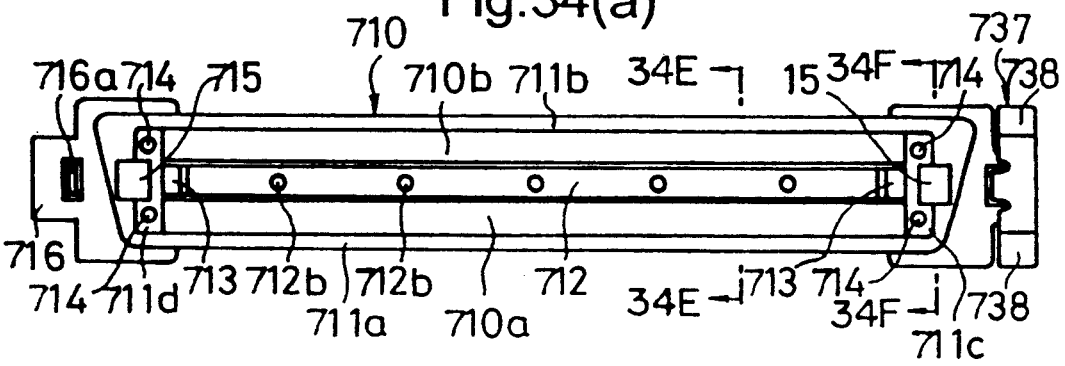
FIGS. 34(*a*)–34(*f*) are, respective, plan, side elevational partly in cross-section, underplan, end elevational, and cross-sectional views along lines 34*e*—34*e* and 34*f*—34*f* of FIG. 34*a* showing a housing member of the receptacle connector of FIG. 31.
Figure 34B:
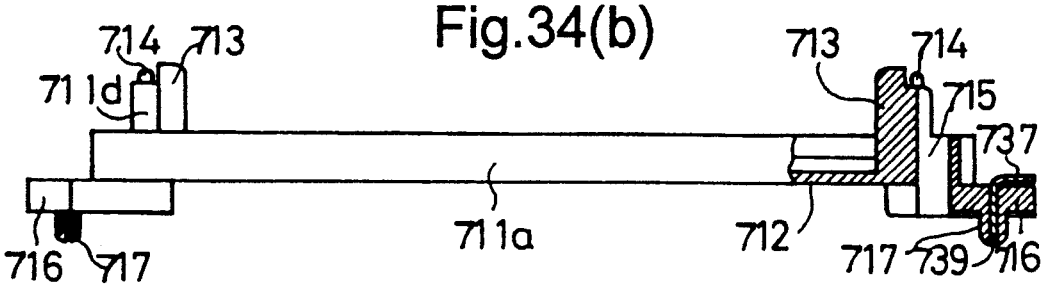
Figure 34C:
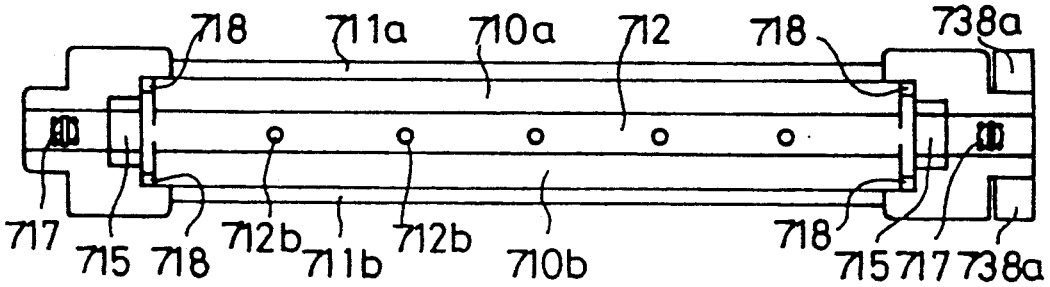
Figure 34D:
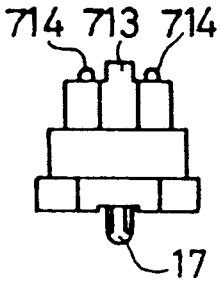
Figure 34E:
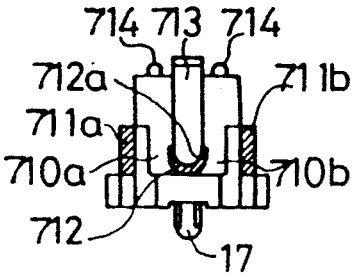
Figure 34F:
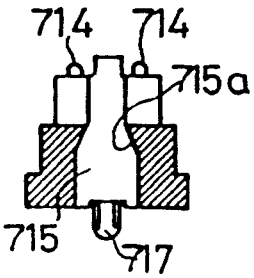
Figure 35A:
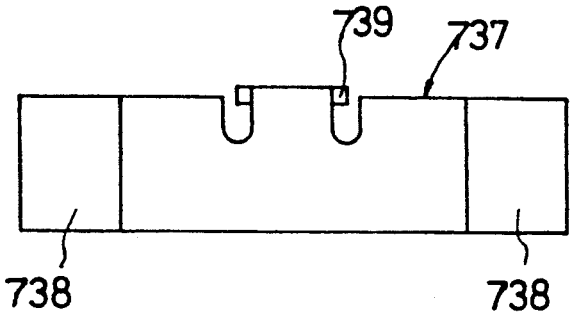
FIGS. 35(*a*) and 35(*b*) are plan and elevational views of a fastening element of the receptacle connector of FIG. 31.
Figure 35B:
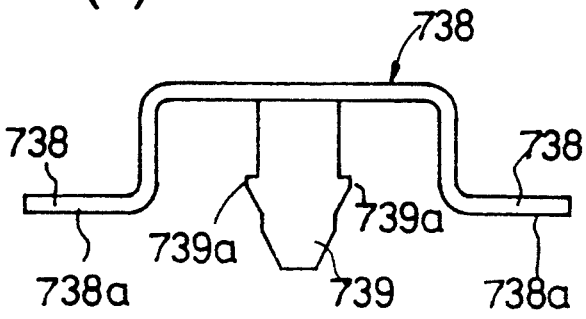
Figure 36A:
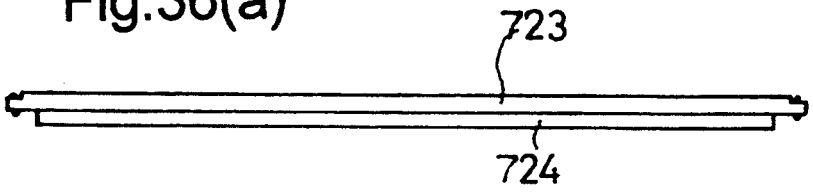
FIGS. 36(*a*)—36(*e*) are plan, side elevational, underplan, opposite side elevational and cross-sectional views, the last being taken along line 36*e*—36*e* of FIG. 36(*b*), of a film positioning and clamping member, of the receptacle connector of FIG. 31.
Figure 36B:
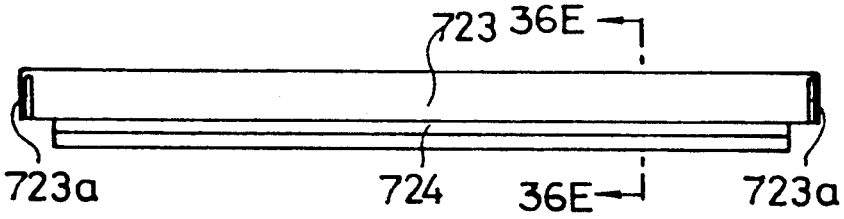
Figure 36C:
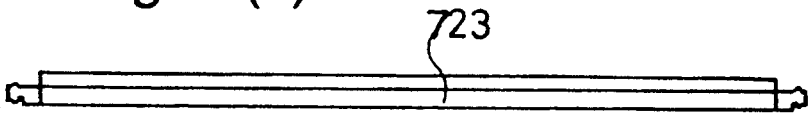
Figure 36D:
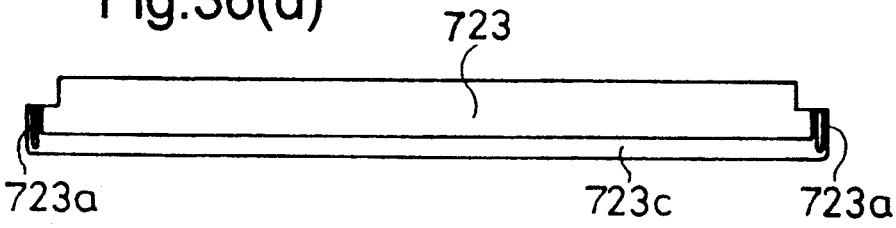
Figure 36E:
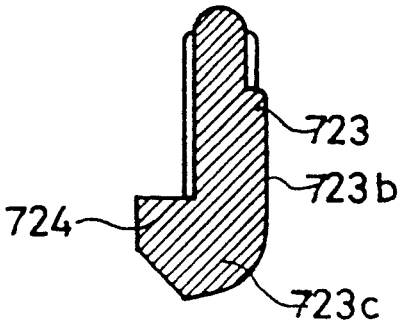
Figure 37A:
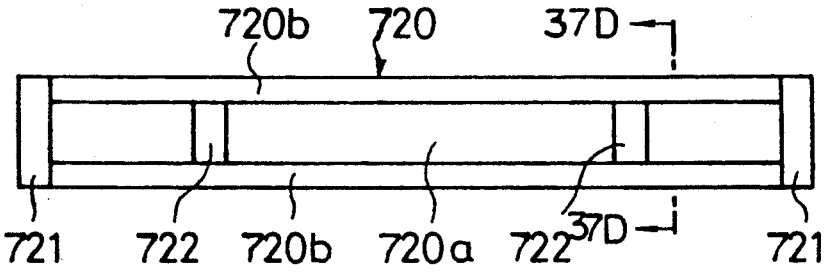
FIGS. 37(*a*)–37(*d*) are, respectively, plan, elevational, underplan and cross-sectional view of a base member of the receptacle connector of FIG. 1, the last view being taken along lines 37*d*—37*d* of FIG. 37(*a*)
Figure 37B:
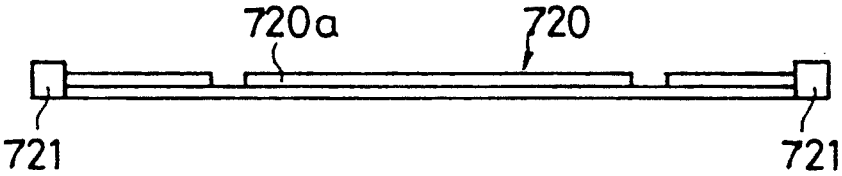
Figure 37C:
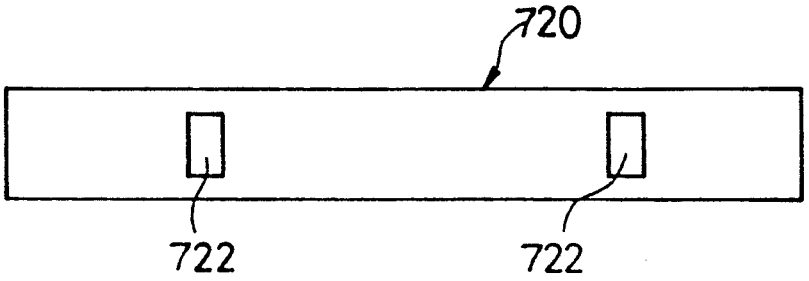
Figure 37D:
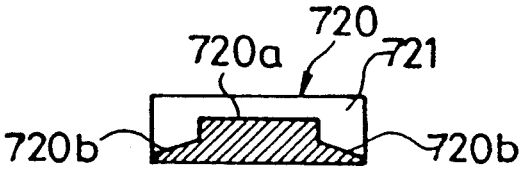
Figures 38A, 38B, 38C, 38D, 38E, 38F, 38G:
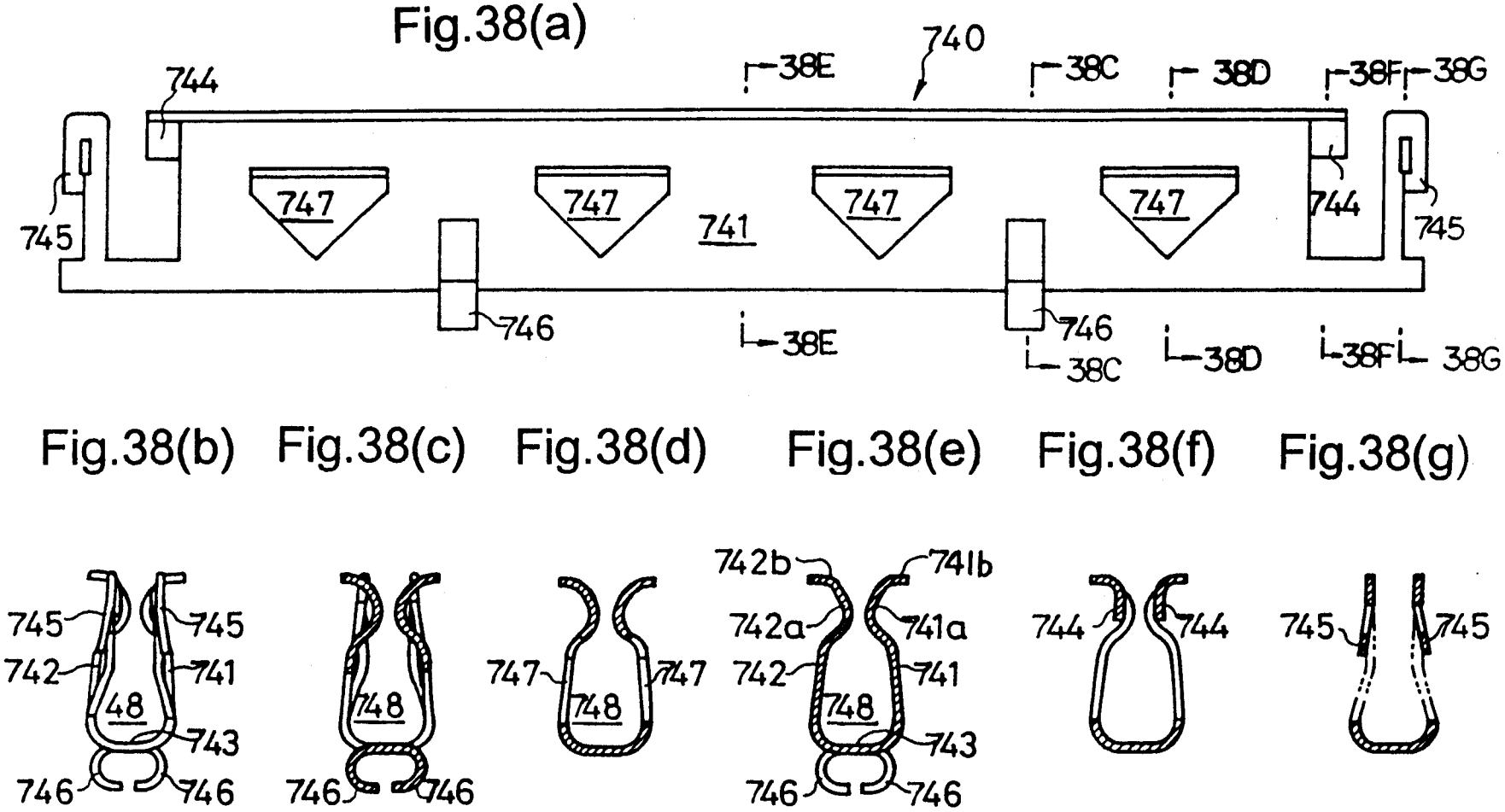
FIGS. 38(*a*) and 38(*b*) are side elevational and end elevational views of a spring of the receptacle connector of FIG. 1.
Figure 39A:
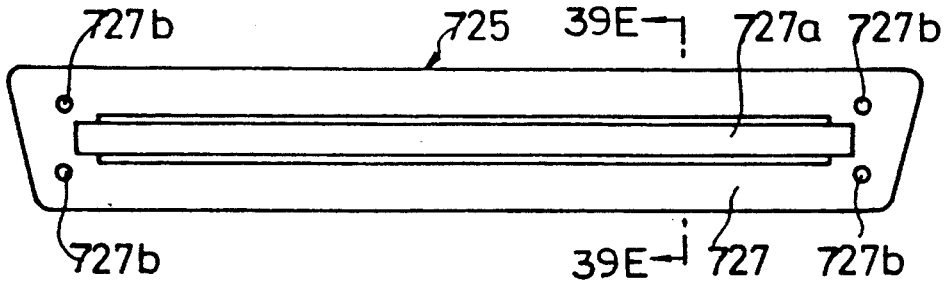
FIGS. 39(*a*)–39(*e*) are, respectively, side elevational partly in cross-section, underplan, end elevational and cross-sectional views of a housing cover member of the receptacle connector of FIG. 1, the cross-section being taken along line 39*e*—39*e* on FIG. 39(*a*)
Figure 39B:
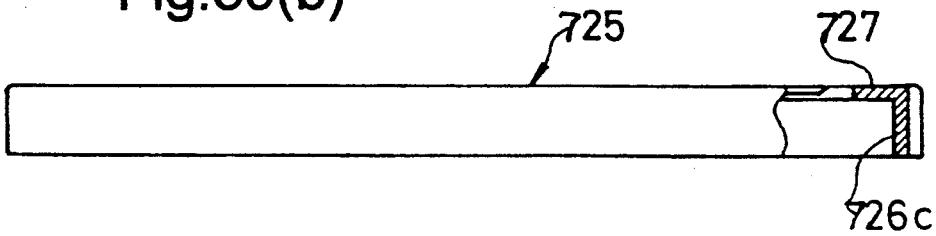
Figure 39C:
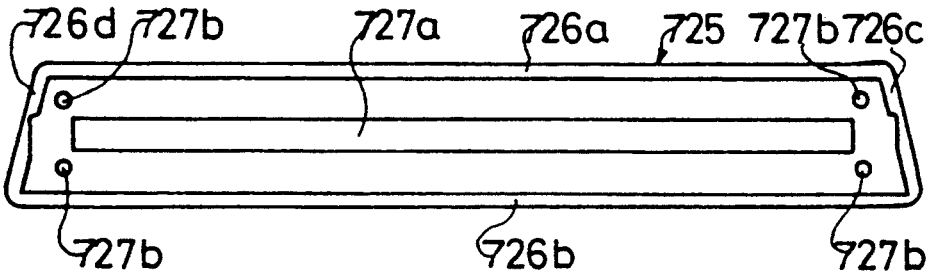
Figure 39D:
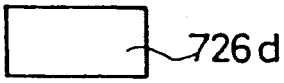
Figure 39E:
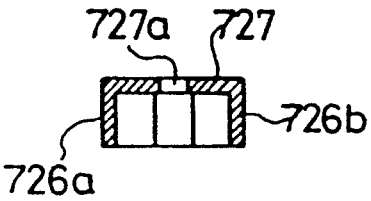

In assembling the receptacle connector, the receptacle spring 740 carrying the film circuit 730 arranged therealong is inserted into the main body 710 with side walls 741 and 742 passing through respective apertures 710*a* and 710*b*, as shown in FIG. 32, and the film positioning and clamping members 723 are inserted into the main body to position the film circuit adjacent the receptacle spring, minimizing the area of circuit board occupied by the connector. The base member 720 and, finally, the cover housing 725 are mounted to complete the assembly.

When the receptacle spring is mounted on the main body the posts 745 are inserted through the rectangular socket 715 until the latches flex past the tapering surfaces 715*a* and resiliently engage over the shoulders in a snap action retaining the receptacle spring assembled with the housing. During insertion, the side walls are flexed apart by engagement of cam following projections 744 with respective opposite sides of caming posts or pillars 713 thereby prestressing the receptacle spring in a preloaded condition.

A film circuit is also secured by receipt of the pins 714 and apertures 733*a* therein.

The film positioning and clamping members 723 are retained in the main housing by press fitted receipt of projections 723*a* in sockets 718, the shoulder formed by the L-shape seating under the respective side walls.

The base member 720 is mounted on the main body by press-fitting the end portions 721 in the lower face thereof, retaining the film circuit between the spring base 743 and supporting portion 720*a* of the base member and between the tapered portions 720*b* and the film circuit engaging surface 723*c* of film portions and clamping members 723. The anchoring and connecting tabs 746 of the receptacle spring then extend through respective windows 22 in the base member exposed for connection to the circuit board.

In fitting the cover housing on the sub-assembly formed above, projections 714 of the main body are press or force fitted into the socket 727*b*. The tongue portions 733 of the film circuit are then clamped between the cover housing and the main body.

As shown in FIGS. 41–46, the plug connector 705 is similar to that of earlier embodiments having an outer housing 750 receiving a film circuit supporting member 760 supporting a film circuit 770.

The plug housing 750 has side walls and end walls 751*a*–751*d* extending away from a mating face to a base wall 752 having a film circuit supporting member receiving slot 752*a* and defining a receptacle connector receiving cavity 755. The flanged longitudinal extension 753 at each end have sockets 753*a* receiving metal fittings 1137 for attachment of the plug connector to a circuit board by surface mount techniques.

The underside of the base wall 752 tapers outwardly as it extends away from each side of the slot 752*a* providing an elongate recess communicating with sockets 754 at respective opposite ends for receiving the foot of the film circuit supporting member.

As shown in FIGS. 43(*a*)–43(*e*), the film circuit supporting member 760 comprises a film circuit supporting wall 761 upstanding from a transverse foot. Grooves 761*a* are formed in respective opposite sides or faces of the wall and received compressible elastomeric members 777. Guide projection 761*b* upstand from leading ends of the film circuit supporting wall for receipt, the respective apertures 712*b* of the receptacle connector rib 712 in the fully mated condition of the plug and receptacle connectors shown in FIGS. 46. The transverse foot tapers as it extends away from the film supporting wall providing inclined film supporting surfaces at 762*a*. Opposite ends of the foot have longitudinal extensions 763 formed with lateral tabs or projections for press fitting in the housing and depending circuit board anchoring posts 764.

The film circuit 770 shown in FIGS. 14(*a*) and 14(*b*) is similar to those of previous examples also being symmetrical with respect to the Center Line and comprises an insulating web 771, conductive tracks 772*a* and 772*b*, a row of medially locating apertures 773 and cut outs 774*a* and 774*b*.

Metal fittings or fasteners 1137 have portions 1138, 1138*a* and 1139 similar in structure to portions 738, 738*a* and 739 of the fittings of FIG. 35.

Assembly of the components of both plug and receptacle is effected quickly and with precision by the cooperative engagement of the guiding and securing portions, interengageable as press or snap fits.

Precise alignment both during and after mating of the plug and socket connectors is assured by receipt of guide pins 761*b* on the leading end of the film supporting wall of the plug in sockets 712*b* of the receptacle rib, the concave profile of the rib surface 712*a* providing a seat for the convex profile of the leading end of the film supporting wall 761 of the plug.

We claim:

1. A connector assembly for film circuitry comprising matable plug and receptacle connector members, the receptacle member including an insulating housing having a mating face and a circuit board engaging face, and providing a plug receiving cavity opening to the mating face; a channel section receptacle spring member of hard material having a base and side walls upstanding from opposite sides of the base, film circuit pressing protuberances on said opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls; means provided on the receptacle connector adjacent the base of the receptacle spring for securing the medial portions of the film circuit adjacent the base and means for securing the end portions of the film circuit within the housing, extending outside the channel section and remote from the mating face so that the film circuit extends throughout the cavity in taut condition with tips of opposite ends thereof extending out of the housing exposed to view from the mating face for connection to a circuit board;

the plug connector comprising a plug housing having a mating face and a circuit board engaging face a plug-like film circuit supporting member; and, a film circuit supported on the film circuit supporting member and having mating contact areas extending away from the mating face in taut condition towards the circuit board engaging face, at least one resiliently compressible spring means extending longitudinally of the film circuit supporting member behind the mating contact areas of the film circuit at locations aligned with the protruberances, in a fully mated condition of the connector whereby, on mating the plug and receptacle members, the film circuit supporting member carrying the film circuit is received in the channel mouth between the protuberances flexing resiliently the side walls apart so that the protuberances and the compressible spring press between them corresponding contact areas of the two film circuits together into engagement to effect stable electrical connection between respective conductive tracks thereof.

2. A connector assembly according to claim 1 in which means are provided on the film circuit supporting member for locating the compressible spring thereon at predetermined locations behind contact areas of the film circuit.

3. A connector assembly according to claim 2 in which the compressible spring member is strip-form and mounted on the film circuit supporting member extending longitudinally thereof.

4. A connector assembly according to claim 3 in which the compressible spring comprises an endless band encircling the film circuit supporting member.

5. A connector assembly according to claim 2 in which the spring locating means includes a spring receiving groove formed in the film circuit supporting member.

6. A connector assembly according to claim 1 in which the spring is elastomeric.

7. A connector assembly according to claim 1 in which the insulating spring receptacle housing walls defining the cavity extending from the mating face towards the circuit board engaging face, the end portions of the film circuit being returned to extend downwardly between the side walls of the spring and the respective cavity walls and out of the housing cavity at locations adjacent the circuit board engaging face for engagement with a circuit board.

8. A connector assembly according to claim 1 in which the receptacle spring member is stamped and formed into channel section from sheet metal stock.

9. A connector assembly according to claim 8 in which anchoring tab portions are struck from opposite side walls of the receptacle spring at locations adjacent the base and bent to extend downwardly therefrom and have laterally extending, circuit board connecting portions for anchoring and electrical connection to the circuit board so that the receptacle spring is in electrically shielding relation to the film circuit contact areas.

10. A connector assembly according to claim 1 in which prestressing means are formed on the insulating receptacle housing for engagement with the receptacle spring walls to maintain them resiliently flexed apart in permanently prestressed condition for engagement with contact areas of the plug during mating movement.

11. A connector assembly according to claim 10 in which prestressing means comprise housing portions aligned for progressive engagement with portions of the side walls of the receptacle spring during insertion of the receptacle spring into the cavity progressively camming the sidewalls apart into the prestressed condition.

12. A connector assembly according to claim 1 in which the receptacle housing cavity has opposite, elongate side walls and opposite end walls extending away from the mating face and defining an aperture remote from the mating face, an elongate film circuit locating rib of greater lateral width than the mouth of the receptacle spring extending along the housing, medially of the aperture, an elongate spring mounting member of rigid insulating material having receptacle spring locating means and film circuit locating portions at opposite sides thereof, the film circuit being receivable in the housing with the medial portion thereof located under the film circuit locating rib and the contact areas extending through the aperture on respective opposite lateral sides of the film circuit locating rib into the cavity towards the mating face and end portions folded back away from the mating face and returned through the aperture on respective opposite lateral sides of the rib, the spring mounting member being insertible into the aperture with the spring base located on the spring locating means by flexure apart of the channel walls riding over the film circuit locating rib with the channel side wall portions and protruberences received in respective folds formed in the film circuit on opposite sides of the medial portion and with the medial portions of the film trapped between the rib and the base of the receptacle spring, the film circuit locating portions engaging trailing end portions of the film circuit trapping them against the respective opposite side walls of the housing and extending out of the housing exposed for connection to a circuit board and with contact areas of the film circuit located by the respective spring protruberences extending inwardly on respective opposite sides of the channel adjacent the mating face, cooperable means being provided for securing the channel spring mounting member to the housing.

13. A connector assembly according to claim 12 in which the receptacle housing has means progressively engagable with the spring for urging the side walls apart into prestressed condition during insertion of the spring into the housing.

14. A connector assembly according to claim 13 in which the receptacle spring locating means comprises a plurality of upwardly projecting locating pegs at intervals therealong, medial portions of the film circuit, the spring base and the film circuit locating rib being formed with pin receiving apertures at locations corresponding to the pegs for receiving such pegs during assembly with the receptacle housing.

15. A connector assembly according to claim 14 in which the locating pegs include relatively long guide pins and relatively short retention pins, the guide pins being received in the apertures of the film circuit and rib prior to the retention pins during the assembly.

16. A connector assembly according to claim 12 in which the securing means comprise complementary pins and sockets on the receptacle spring mounting member and receptacle walls engagable as interference fits to secure the mounting member and the receptacle housing assemble together.

17. A connector assembly according to claim 12 in which the receptacle spring mounting member is of channel section, the film circuit locating portions being formed by wall portions of the channel.

18. A connector assembly according to claim 1 in which the plug connector comprises an outer insulating housing having an elongate base wall adjacent the circuit board engaging face and remote from the mating face, and formed with an elongate plug receiving slot extending longitudinally therein, integrally formed columnar members upstanding from the base towards the mating face at opposite ends of the slots and integrally joined at upper ends by a bridge portion aligned over the slot and formed with a series of locating sockets opening towards the slot;

the film circuit supporting member comprises a wall portion upstanding from an integral transverse foot portion and having an upper leading end formed with a series of locating pins at intervals corresponding to the sockets, the film circuit having a medial portion formed with a series of apertures at intervals corresponding to the locating pins and being located on the film circuit supporting wall with the locating pins received in the respective apertures in the respective apertures and the film circuit dressed down opposite sides of the wall away from the leading end and the sub-assembly so formed inserted through the slot, leading end first, so that the locating pins are received in respective sockets of the bridge portion trapping the medial portion of the film between the leading end of the wall and the bridge portion with the film circuit contact areas extending down opposite sides of the wall across the resilient member and trailing ends trapped between the film circuit supporting member foot and the base wall extending out of the housing exposed for connection to a circuit board and means securing the film circuit supporting member to the outer housing.

19. A connector assembly according to claim 1 in which the film circuits each comprises a series of conductive tracks extending across a web of insulating material away from the medial portion and having a row of mating contact portions in the contact areas exposed to the front mating face of the associated housing joined by respective linking portions insulated from the mating face to respective board connecting portions exposed to a rear face of the associated housing for connection to a circuit board.

20. A connector assembly according to claim 19 in which the mating contact portions are on a front surface of the web and the linking portions are formed on a rear surface of the web and the conductive track portions are connected at respective adjacent ends by plated through-apertures in the web.

21. A connector assembly according to claim 20 in which the respective board connecting portions are formed on the front face of the web.

22. A connector assembly according to claim 21 in which the linking portions are covered by an insulating coating on the rear face of the web.

23. A connector assembly according to claim 22 in which the board connecting portions extend across the respective apertures aperture in the insulating web exposed to the front face of the web for connection to the circuit board.

24. A connector assembly according to claim 9 in which the circuit board connecting portions extend laterally towards each other.

25. A connector assembly according to claim 24 in which means are provided on the receptacle housing and on the receptacle spring, interengagable in a snap action, for securing the receptacle spring to the receptacle housing.

26. A receptacle connector according to claim 25 in which the securing means comprises portions extending longitudinally from respective opposite ends of the channel and posts upstanding from opposite ends of the portions with resilient latch means at upper ends of respective posts and post receiving sockets are formed on the receptacle housing and have locking shoulders engagable by the latching means by insertions of the receptacle spring into the receptacle housing with the posts received in respective apertures.

27. A connector assembly according to claim 1 including film positioning and clamping members having film engaging lands and receivable in the receptacle housing at the board connecting face between end portions of the film circuit and the housing side walls with the film engaging lands spacing the end portions of the film away from the housing side walls towards the receptacle spring base and clamping trailing end portions against the receptacle spring mounting member.

28. A connector assembly according to claim 27 in which means are provided on the film positioning and clamping member and on the receptacle housing engagable as a force fit when the film positioning and clamping member is inserted into the receptacle housing through the aperture at the board engaging face, securing the film positioning and clamping member assembled with the housing.

29. A connector assembly according to claim 28 in which the securing means comprises longitudinally extending recesses formed in side walls of the receptacle housing at locations adjacent the circuit board engaging face and shoulders on the film positioning and clamping members seated in the respective recesses.

30. A connector assembly for film circuitry comprising matable plug and receptacle connector members, the receptacle member including an insulating housing having a mating face and providing a plug receiving cavity opening to the mating face; a pair of channel section receptacle springs each having a base and side walls upstanding from opposite sides of the base, film circuit pressing protuberances on respective side walls at locations remote from the base and extending inwardly of the channel, providing a channel mouth, the receptacle springs being mounted in the housing in side by side relation with the channel mouths opening towards the mating face; a film circuit mounted in the housing in taut condition and having a portion inserted in the channel and mating contact areas extending over the protuberances away from the mating face and opposite end portions extending out of the channel over respective channel side walls;

the plug connector comprising a plug housing having a mating face and a pair of plug-like film circuit supporting members mounted in the housing in side by side relation; and, a film circuit supported on the film circuit supporting members and having mating contact areas extending away from the mating face in taut condition, at least one resiliently compressible spring means extending longitudinally of each of the film circuit supporting member behind the mating contact areas of the film circuit at locations aligned with the protruberances, in a fully mated condition of the connector whereby, on mating the plug and receptacle members, the film circuit supporting members carrying the film circuit are received in the respective channel mouths between the respective protuberances flexing resiliently the side walls apart so that the protuberances and the compressible springs press between them corresponding contact areas of the two film circuits together into engagement to effect permanent electrical connection between respective conductive tracks thereof.

31. A receptacle connector for film circuitry comprising an insulating housing having a mating face and opposite side walls and end walls extending away from the mating face and providing a plug receiving cavity opening to the mating face and defining a cavity aperture remote from the mating face; an elongate film circuit locating rib extending along the housing, medially of the aperture; a channel section spring member having a base and side walls upstanding from opposite sides of the base, film circuit pressing protuberances on opposite side walls at locations remote from the base and extending inwardly of the channel, providing a channel mouth of restricted size; an elongate spring mounting member of rigid insulating material having receptacle spring locating means and film circuit locating portions at opposite longitudinally extending sides thereof; and, a film circuit receivable in the housing with a medial portion thereof located under the film circuit locating rib and the mating contact areas extending through the aperture on respective opposite lateral sides of the film circuit locating rib into the cavity towards the mating face and film circuit end portions extending away from opposite sides of the medial portion and folded back away from the mating face and returned through the aperture on respective opposite lateral sides of the rib, the spring mounting member being insertible into the aperture carrying the spring base located on the spring locating means with the channel mouth towards the mating face and channel side walls and protruberences on respective opposite sides of the rib and received in respective folds formed in the film circuit on respective opposite sides of the medial portion trapping the medial portions of the film between the rib and the base of the receptacle spring with the film circuit locating portions engaging end portions of the film circuit remote from the medial portion, pressing them against the respective opposite side walls of the housing thereby trapping the film circuit in the cavity in taut condition with contact areas of the film circuit covering the respective spring protruberances and extending inwardly on respective opposite sides of the channel adjacent the mating face, and with trailing end potions of the film circuit extending out of the housing exposed for connection to a circuit board, means being provided for securing the channel spring mounting member to the housing.

32. A connector assembly according to claim 31 in which the rib is of greater lateral width than the mouth of the receptacle spring, the receptacle spring being mounted in the housing by flexure apart of the channel walls to ride over the rib.

33. A connector assembly according to claim 31 in which the receptacle housing has means progressively engagable with the spring for urging the side walls apart into prestressed condition during insertion of the spring into the housing.

34. A connector assembly according to claim 31 in which the receptacle spring locating means comprises a plurality of upwardly projecting locating pegs at intervals therealong, medial portions of the film circuit, the spring base and the film circuit locating rib being formed with pin receiving apertures at locations corresponding to the pegs for receiving such pegs during assembly with the receptacle housing.

35. A connector assembly according to claim 34 in which the locating pegs include relatively long guide pins and relatively short retention pins, the guide pins being received in the apertures of the film circuit and rib prior to the retention pins during the assembly.

36. A connector assembly according to claim 31 in which the securing means comprise complementary pins and sockets on the receptacle spring mounting member and receptacle walls engagable as interference fits to secure the mounting member and the receptacle housing assemble together.

37. A connector assembly according to claim 31 in which the receptacle spring mounting member is of channel section, the film circuit locating portions being formed by wall portions of the channel.

38. A receptacle connector for film circuitry comprising an insulating housing having a mating face and opposite side walls and end walls extending away from the mating face and providing a plug receiving cavity opening to the mating face and defining a cavity aperture remote from the mating face; a channel section receptacle spring member having a base and side walls upstanding from opposite sides of the base, film circuit pressing protuberances on said opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls; film positioning and clamping members having film engaging lands and receivable in the receptacle housing at a board connecting face between said opposite end portions of the film circuit and the housing side walls with the film engaging lands locating said opposite end portions of the film circuits spaced apart from the housing side walls and clamping trailing end portions of said opposite end portions against the receptacle spring mounting member.

39. A receptacle connector according to claim 38 including means provided on the film positioning and clamping member and on the receptacle housing engagable as a force fit when the film positioning and clamping member is inserted into the receptacle housing through the aperture at the board engaging face, securing the film positioning and clamping member assembled with the housing.

40. A connector assembly according to claim 39 in which the securing means comprises longitudinally extending recesses formed in side walls of the receptacle housing at locations adjacent the circuit board engaging face and shoulders on the film positioning and clamping members seated in the respective recesses.

41. A connector assembly for film circuitry comprising matable plug and receptacle connector members, the receptacle member including an insulating housing having a mating face and providing a plug receiving cavity opening to the mating face; a channel section receptacle spring member stamped and formed from sheet metal stock and having a base and side walls upstanding from opposite sides of the base, film circuit pressing protuberances on said opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls;

anchoring tab portions being struck from opposite side walls of the receptacle spring at locations adjacent the base and bent to extend downwardly therefrom and having laterally extending, circuit board connecting portions for anchoring and electrical connection to a circuit board so that the receptacle spring is in electrically shielding relation to the film circuit contact areas;

the plug connector comprising a plug housing having a mating face and a plug-like film circuit supporting member; and, a film circuit supported on the film circuit supporting member and having mating contact areas extending away from the mating face in taut condition, at least one resiliently compressible spring means extending longitudinally of the film circuit supporting member behind the mating contact areas of the film circuit at locations aligned with the protruberances, in a fully mated condition of the connector whereby, on mating the plug and receptacle members, the film circuit supporting member carrying the film circuit is received in the channel mouth between the protuberances flexing resiliently the side walls apart so that the protuberances and the compressible spring press between them corresponding contact areas of the two film circuits together into engagement to effect stable electrical connection between respective conductive tracks thereof.

42. A connector assembly for connecting film circuitry to a circuit board film circuitry comprising matable plug and receptacle connector members, the receptacle member including an insulating housing having a mating face and providing a plug receiving cavity opening to the mating face; a channel section receptacle spring member stamped and formed from sheet metal stock and having a base and side walls upstanding from opposite sides of the base, film circuit pressing protuberances on said opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls;

anchoring tab portions being struck from opposite side walls of the receptacle spring at locations adjacent the base and bent to extend downwardly therefrom and having laterally extending, circuit board connecting portions for anchoring and electrical connection to the circuit board so that the receptacle spring is in electrically shielding relation to the film circuit contact areas.

43. A connector assembly for film circuitry comprising matable plug and receptacle connector members, the receptacle member including an insulating housing having a mating face and providing a plug receiving cavity opening to the mating face; a channel section receptacle spring member having a base and side walls upstanding from opposite sides of the base, film circuit pressing protuberances on said opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls;

the plug connector comprising a plug housing having a mating face and a plug-like film circuit supporting member;

the plug housing comprising an outer insulating housing having an elongate base wall remote from the mating face and formed with an elongate film circuit supporting member receiving slot extending longitudinally therein, integrally formed columnar members upstanding from the base towards the mating face at opposite ends of the slots and integrally joined at upper ends by a bridge portion aligned over the slot and formed with a series of locating sockets opening towards the slot;

the film circuit supporting member comprising a wall portion upstanding from an integral transverse foot portion and having an upper leading end formed with a series of locating pins at intervals corresponding to the sockets and at least one resiliently compressible spring means extending longitudinally of the film circuit supporting member; and, a film circuit having a medial portion formed with a series of apertures at intervals corresponding to the locating pins and being located on the film circuit supporting wall with the locating pins received in the respective apertures and the film circuit dressed down opposite sides of the wall away from the leading end, with mating contact areas of the film circuit overlying said at least one resiliently compressible spring means at locations for alignment with the protruberances, in a fully mated condition of the connector, and the sub-assembly of the film circuit supporting member and the film circuit so formed inserted through the slot, leading end first, so that the locating pins are received in respective sockets of the bridge portion, trapping the medial portion of the film between the leading end of the wall and the bridge portion with the film circuit mating contact areas extending away from the mating face down opposite sides of the wall across the resilient member in taut condition, and trailing ends of the film circuit trapped between the film circuit supporting member foot and the base wall extending out of the housing exposed for connection to a circuit board and means securing the film circuit supporting member to the outer housing, whereby, on mating the plug and receptacle members, the film circuit supporting member carrying the film circuit is received in the channel mouth between the protuberances, flexing resiliently the side walls apart so that the protuberances and the compressible spring press between them corresponding contact areas of the two film circuits together into engagement to effect stable electrical connection between respective conductive tracks thereof.

44. A connector assembly according to claim 43 in which the securing means comprises complementary male and female members formed on the outer housing and the film circuit supporting member, respectively, engagable in a force fit on assembling the outer housing and the film circuit supporting member together.

45. A connector assembly according to claim 43 in which means are provided on the plug connector to anchor the plug connector to a circuit board.

46. A connector assembly according to claim 43 in which complementary guide means are provided on the bridge and the film circuit locating ribs of the receptacle housing interengagable on mating for accurately aligning and locating the plug and socket connector assembled together.

47. A connector assembly according to claim 43 in which locating sockets are formed in the bridge portion and leading end of the film circuit supporting wall at intervals corresponding to the locations of guide pins provided on the receptacle connector so that the guide pins are received therein on mating, accurately locating the plug and socket connectors together.

48. A connector assembly according to claim 43 in which the outer plug housing has shoulders facing away from the mating face and film circuit locating member clamping means comprising an elongate strain relieving clamping member having an elongate slot extending centrally therealong and resilient locking arms upstanding from respective ends thereof on respective opposite sides of the slot, the resilient locking arms having hook means on free ends thereof whereby the film circuit supporting member can be clamped in the housing by receipt of the base thereof in the slot with the film circuit dressed along opposite sides thereof and the locking arms received as a snap fit on the housing with the hooks engaged respective shoulders, so that the film circuit supporting member is clamped in the housing extending towards the mating face with the film circuit clamped between walls defining the slot of the clamping member and the base of the film circuit supporting member.

49. A connector assembly for film circuitry comprising matable plug and receptacle connector members, the receptacle member including an insulating housing having a mating face and providing a plug receiving cavity opening to the mating face; a channel section receptacle spring member having a base and side walls upstanding from opposite sides of the base, film circuit pressing protuberances on said opposite side wall at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls; film positioning and clamping members having film engaging lands and receivable in the receptacle housing at the board connecting face between end portions of the film circuit and the housing side walls with the film engaging lands spacing the end portions of the film away from the housing side walls towards the receptacle spring base and clamping trailing end portions against the receptacle spring mounting member;

the plug connector comprising a plug housing having a mating face and a plug-like film circuit supporting member; and, a film circuit supported on the film circuit supporting member and having mating contact areas extending away from the mating face in taut condition, at least one resiliently compressible spring means extending longitudinally of the film circuit supporting member behind the mating contact areas of the film circuit at locations aligned with the protruberances, in a fully mated condition of the connector whereby, on mating the plug and receptacle members, the film circuit supporting member carrying the film circuit is received in the channel mouth between the protuberances flexing resiliently the side walls apart so that the protuberances and the compressible spring press between them corresponding contact areas of the two film circuits together into engagement to effect stable electrical connection between respective conductive tracks thereof.

50. A connector assembly for film circuitry comprising matable plug and receptacle connector members, the receptacle member including an insulating housing having a mating face and providing a plug receiving cavity opening to the mating face; a channel section receptacle spring member having a base and side walls upstanding from opposite sides of the base, film circuit pressing protuberances on said opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls, means being provided on the receptacle connector located along the channel section base for securing the medial portions of the film circuit adjacent the channel section base and means being provided for securing the end portions of the film circuit in the housing, extending outside the channel section adjacent the circuit board engaging face so that the film circuit extends throughout the cavity in taut condition; film positioning and clamping members having film engaging lands and receivable in the receptacle housing at the board connecting face between end portions of the film circuit and the housing side walls with the film engaging lands spacing the end portions of the film away from the housing side walls towards the receptacle spring base and clamping trailing end portions against the receptacle spring mounting member.

51. A connector assembly for film circuitry comprising matable plug and receptacle connector members, the receptacle member including an insulating housing having a mating face and providing a plug receiving cavity opening to the mating face; a channel section receptacle spring member having a base and side walls upstanding from opposite sides of the base, film circuit pressing protuberances on said opposite side walls at locations remote from the base and extending inwardly of the channel, providing a channel mouth, the receptacle spring being mounted in the housing with the channel mouth opening towards the mating face; a film circuit mounted in the housing in taut condition and having a medial portion inserted in the channel and mating contact areas extending over the protuberances away from the mating face and opposite end portions extending out of the channel over respective channel side walls; prestressing means comprising housing portions aligned for progressive engagement with portions of the side walls of the receptacle spring during insertion of the receptacle spring into the cavity progressively camming the sidewalls apart into a permanently prestressed condition for engagement with contact areas of the plug connector during mating movement;

the plug connector comprising a plug housing having a mating face and a plug-like film circuit supporting member; and, a film circuit supported on the film circuit supporting member and having mating contact areas extending away from the mating face in taut condition, at least one resiliently compressible spring means extending longitudinally of the film circuit supporting member behind the mating contact areas of the film circuit at locations aligned with the protruberances, in a fully mated condition of the connector whereby, on mating the plug and receptacle members, the film circuit supporting member carrying the film circuit is received in the channel mouth between the protuberances flexing resiliently the side walls apart so that the protuberances and the compressible spring press between them corresponding contact areas of the two film circuits together into engagement to effect stable electrical connection between respective conductive tracks thereof.

* * * * *